US006430294B1

(12) United States Patent
Fujita et al.

(10) Patent No.: US 6,430,294 B1
(45) Date of Patent: Aug. 6, 2002

(54) SOUND IMAGE LOCALIZATION METHOD AND APPARATUS, DELAY AMOUNT CONTROL APPARATUS, AND SOUND IMAGE CONTROL APPARATUS WITH USING DELAY AMOUNT CONTROL APPARATUS

(75) Inventors: Akihiro Fujita; Kenji Kamada; Kouji Kuwano, all of Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 09/362,148

(22) Filed: Jul. 28, 1999

Related U.S. Application Data

(62) Division of application No. 08/953,314, filed on Oct. 17, 1997, now Pat. No. 6,035,045.

(30) Foreign Application Priority Data

Oct. 22, 1996 (JP) ..... 8-298081
Nov. 27, 1996 (JP) ..... 8-331497

(51) Int. Cl.[7] ..... H04R 5/00
(52) U.S. Cl. ..... 381/17; 381/61
(58) Field of Search ..... 381/61, 63, 17, 381/18; 84/630, DIG. 26

(56) References Cited

U.S. PATENT DOCUMENTS 5,235,646 A * 8/1993 Wilde et al. ..... 381/97
5,553,150 A * 9/1996 Kozuki ..... 381/63
5,684,881 A * 11/1997 Serikawa et al. ..... 381/17
5,878,145 A * 3/1999 Adams ..... 381/17

FOREIGN PATENT DOCUMENTS

| | | |
|---|---|---|
| JP | 50-13002 | 2/1975 |
| JP | 53-137101 | 11/1978 |
| JP | 5-91598 | 4/1993 |

* cited by examiner

*Primary Examiner*—Ping Lee
(74) *Attorney, Agent, or Firm*—Christie, Parker & Hale, LLP

(57) ABSTRACT

A delay amount control apparatus is arranged by a delay amount detecting unit, a delay amount saving unit, a delay unit, and a cross-fade mixing unit. The delay amount detecting unit detects as to whether or not the delay coefficient is changed. The delay amount saving unit saves a delay coefficient before being changed when the delay amount detecting unit detects that the delay coefficient is changed. Then, the delay unit outputs a first delay signal produced by delaying the externally supplied input signal by a delay amount designated by the delay coefficient before being changed, which is saved in the delay amount saving unit, and also a second delay signal produced by delaying the externally supplied input signal by a delay amount designated by the externally supplied delay coefficient. The cross-fade mixing unit cross-fades the first delay signal and the second delay signal outputted from the delay unit so as to mix the first delay signal with the second delay signal.

6 Claims, 22 Drawing Sheets

EXTERNALLY SUPPLIED DELAY COEFFICIENT

DELAY AMOUNT CHANGE DETECTION SIGNAL A

DELAY COEFFICIENT BEFORE BEING CHANGED

FIRST CROSS-FADE COEFFICIENT B

SECOND CROSS-FADE COEFFICIENT 1-B

SOUND IMAGE LOCALIZATION METHOD AND APPARATUS, DELAY AMOUNT CONTROL APPARATUS, AND SOUND IMAGE CONTROL APPARATUS WITH USING DELAY AMOUNT CONTROL APPARATUS

This application is a division of 08/953,314 U.S. Pat. No. 6,035,045.

BACKGROUND OF THE INVENTION

1. Field of the Invention

The present invention generally relates to sound image localization method/apparatus and also a sound image control apparatus. More specifically, the present invention is directed to a sound image localization apparatus and a sound image localization method, capable of localizing a sound image at an arbitrary position within a three-dimensional space, which are used in, for instance, electronic musical instruments, game machines, and acoustic appliances (e.g. mixers). Also, the present invention is directed to a delay amount control apparatus for simulating an inter aural time difference changed in connection with movement of a sound image based upon variation of a delay amount, and also to a sound image control apparatus for moving a sound image by employing this delay amount control apparatus.

2. Description of the Related Art

Conventionally, such a technical idea is known in the field that 2-channel stereophonic signals are produced, and these stereophonic signals are supplied to right/left speakers so as to simultaneously produce stereophonic sounds, so that sound images may be localized. In accordance with this sound image localization technique, the sound images are localized by changing the balance in the right/left sound volume, so that the sound images could be localized only between the right/left speakers.

To the contrary, very recently, several techniques have been developed by which sound images can be localized at an arbitrary position within a three-dimensional space. As one of sound image localization apparatus using this conventional sound image localization technique, an input signal is processed by employing a head related acoustic transfer function so as to localize a sound image. In this case, a head related acoustic transfer function implies such a function for indicating a transfer system defined by such that a sound wave produced from a sound source receives effects such as reflection, diffraction, and resonance caused by a head portion, an external ear, a shoulder, and so on, and then reaches an ear (tympanic membrane) of a human body.

In this conventional sound image localization apparatus, when sounds are heard by using a headphone, first to fourth head related acoustic transfer functions are previously measures. That is, the first head related acoustic transfer function of a path defined from the sound source to a left ear of an audience is previously measured. The second head related acoustic transfer function of a path defined from the sound source to a right ear of the audience is previously measured. The third head related acoustic transfer function of a path defined from a left headphone speaker to the left ear of the audience is previously measured, and the fourth head related acoustic transfer function of a path defined from the right headphone speaker to the right ear of this audience is previously measured. Then, the signals supplied to the left headphone speaker are controlled in such a manner that the sounds processed by employing the first head related acoustic transfer function and the third head related acoustic transfer function are made equal to each other near the left external ear of the audience. Also, the signals supplied to the right headphone speaker are controlled in such a manner that the sounds processed by employing the second head related acoustic transfer function and the fourth head related acoustic transfer function are made equal to each other near the right external ear of the audience. As a consequence, the sound image can be localized at the sound source position.

When the sounds are heard by using speakers, head related acoustic transfer functions of paths defined from the left speaker to the right ear and from the right speaker to the left ear are furthermore measured. While employing these head related acoustic transfer functions, the sounds which pass through these paths and then reach the audience (will be referred to as "crosstalk sounds" hereinafter) are removed from the sounds produced by using the speakers. As a consequence, since a similar sound condition to that of the headphone can be established, the sound image can be localized at the sound source position.

One example of the above-described conventional sound image localization apparatus is shown in FIG. 1. In FIG. 1, a data memory 50 stores a plurality of coefficient sets. Each coefficient set is constructed of a delay coefficient, a filter coefficient, and an amplification coefficient. Each of these coefficient sets corresponds to a direction of a sound source as viewed from an audience, namely a direction (angle) along which a sound image is localized. For instance, in such a sound image localization apparatus for controlling the sound image localization direction every 10 degrees, 36 coefficient sets are stored in this data memory. The externally supplied sound image localization direction data may determine which coefficient set is read out from this data memory. Then, the delay coefficient contained in the read coefficient set is supplied to a time difference signal producing device 51, the filter coefficient is supplied to a left head related acoustic transfer function processor 52 and also to a right head related acoustic transfer function processor 53, and further the amplification coefficient is supplied to a left amplifier 54 and a right amplifier 55.

The time difference signal producing device 51 is arranged by, for example, a delay device, and may simulate a difference between a time when a sound produced from a sound source reaches a left ear of an audience, and another time when this sound reaches a right ear of this audience (will be referred to as an "inter aural time difference" hereinafter). For example, both a monaural input signal and a delay coefficient are inputted into this time difference signal producing device 51.

In this case, a direction of a sound source as viewed from an audience, namely a direction (angle) along which a sound image is localized will now be defined, as illustrated in FIG. 2. In this case, it is assumed that a front surface of the audience is a zero (0) degree. In general, an inter aural time difference becomes minimum when the sound source is directed to the zero-degree direction, is increased while the sound source is changed from this zero-degree direction to a 90-degree direction, and then becomes maximum in the 90-degree direction. Furthermore, the inter aural time difference is decreased while the sound source is changed from this 90-degree direction to a 180-degree direction, and then becomes minimum in a 180-degree direction. Similarly, the inter aural time difference is increased while the sound source is changed from the 180-degree direction to a 270-degree direction, and then becomes maximum in this 270-degree direction. The inter aural time difference is decreased while the sound source is changed from the 270-degree direction to the zero-degree (360-degree) direction, and then becomes minimum in the zero-degree direction again. The delay coefficients supplied to the time difference signal producing device 51 own values corresponding to the respective angles.

When the sound image localization direction data indicative of a degree larger than, or equal to 0 degree, and smaller than 180 degrees is inputted, the time difference signal producing device 51 directly outputs this input signal (otherwise delays this input signal only by a predetermined time) as a first time difference signal, and also outputs a second time difference signal delayed from this first time difference signal only by such an inter aural time difference corresponding to the delay coefficient. Similarly, when the sound image localization direction data indicative of a degree larger than, or equal to 180 degrees, and smaller than 360 degrees is inputted, the time difference signal producing device 51 directly outputs this input signal (otherwise delays this input signal only by a predetermined time) as a second time difference signal, and also outputs a first time difference signal delayed from this second time difference signal only by such an inter aural time difference corresponding to the delay coefficient. The first time difference signal produced from the time difference signal producing device 51 is supplied to the left head related acoustic transfer function processor 52, and the second time difference signal produced therefrom is supplied to the right head related acoustic transfer function processor 53.

The left head related acoustic transfer function processor 52 is arranged by, for instance, a six-order FIR filter, and simulates a head related acoustic transfer function of a sound entered into the left ear of the audience. The above-described first time difference signal and a filter coefficient for a left channel are entered into this left head transfer function processor 52. The left head related acoustic transfer function processor 52 convolutes the impulse series of the head related acoustic transfer function with the input signal by employing the filter coefficient for the left channel as the coefficient of the FIR filter. The signal processed from this left head related acoustic transfer function processor 52 is supplied to an amplifier 54 for the left channel.

The right head related acoustic transfer function processor 53 simulates a head related acoustic transfer function of a sound entered into the right ear of the audience. The above-described second time difference signal and a filter coefficient for a right channel are entered into this right head transfer function processor 53, which is different from the left head related acoustic transfer function processor 52. Other arrangements and operation of this right head related acoustic transfer function processor 53 are similar to those of the above-explained left head related acoustic transfer function processor 52. A signal processed from this right head related acoustic transfer function processor 53 is supplied to an amplifier 55 for a right channel.

The amplifier 54 for the left channel simulates a sound pressure level of a sound entered into the left ear of the audience, and outputs the simulated sound pressure level as the left channel signal. Similarly, the amplifier 55 for the right channel simulates a sound pressure level of a sound entered into the right ear, and outputs the simulated sound pressure level as the right channel signal. With employment of this arrangement, for instance, when the sound source is directed along the 90-degree direction, the sound pressure level of the sound entered into the left ear becomes maximum, whereas the sound pressure level of the sound entered into the right ear becomes minimum.

In accordance with the sound image localization apparatus with employment of above-explained arrangement, when the sounds are heard by using the headphone, no extra device is additionally required, whereas when the sounds are heard by using the speakers, the means for canceling the crosstalk sounds is further provided, so that the sound image can be localized at an arbitrary position within the three-dimensional space.

However, since the left head related acoustic transfer function processor and the right head related acoustic transfer function processor are separately provided in this conventional sound image localization apparatus, 12-order filters are required in total. As a result, in such a case that these right/left head related acoustic transfer function processors are constituted by using the hardware, huge amounts of delay elements and amplifiers are required, resulting in the high-cost and bulky sound image localization apparatus. In the case that the right/left head related acoustic transfer function processors are constituted by executing software programs by a digital signal processor (will be referred to as a "DSP" hereinafter), a very large amount of processing operations is necessarily required. As a consequence, since such a DSP operable in high speeds is required so as to process the data in real time, the sound image localization apparatus becomes high cost.

Furthermore, since the coefficient sets must be stored every sound image localization direction, such a memory having a large memory capacity is required. To further control the direction (angle) along with the sound image is localized in order to improve the precision of the sound image localization, a memory having a further large memory capacity is needed. There is another problem that the real time data processing operation is deteriorated, because the coefficient sets must be replaced every time the direction along which the sound image is localized is changed.

On the other hand, another conventional sound image localization apparatus capable of not only localizing the sound image, but also capable of moving the sound image has been developed. As such an apparatus to which the technique for moving the sound image has been applied, for instance, Japanese Laid-open Patent Application (JP-A-Heisei 04-30700) discloses the sound image localization apparatus. This disclosed sound image localization apparatus is equipped with sound image localizing means constituted by delay devices and higher-order filters. The head related acoustic transfer function is simulated by externally setting the parameters arranged by the delay coefficient and the filter coefficient. This head related transfer coefficient will differ from each other, depending upon the localization positions of the sound image as viewed from the audience. Therefore, in order that the sound image is localized at a large number of positions, this conventional sound image localization apparatus owns a large quantity of parameters corresponding to the respective localization positions.

In general, when a localization position of a sound image is moved from a present position to a new position, a parameter corresponding to this new position may be set to the sound image localization means. However, if the parameter is simply set to the sound image localization means while producing the signal, then discontinuous points are produced in the signal under production, which causes noise. To avoid this problem, this conventional sound image localization apparatus is equipped with first sound image localization means and second sound image localization means, and further means for weighting the output signals from the respective sound image localization means by way of the cross-fade system.

It is now assumed that the sound image is localized at the first position in response to the first localization signal derived from the first sound image localization means. When this sound image is moved to the second position, the weight of "1" is applied to the first localization signal derived from the first sound image localization means, and also the weight of "0" is applied to the sound localization signal derived from the second sound image localization means. Under these conditions, the parameter used to localize the sound image to the second position is set to the second sound image localization means. Since the second localization signal is weighted by "0", there is no possibility that noise is produced in the second localization signal when the parameter is set.

The weight of the first localization signal is gradually decreased from this state, and further the weight of the second localization signal is gradually increased. Then, after a predetermined time has elapsed, the weight to be applied to the first localization signal is set to "0", and the weight to be applied to the second localization signal is set to "1". As a result, moving of the sound image from the first position to the second position is completed without producing the noise.

The above-described sound image moving process is normally carried out by employing, for example, a DSP. In this case, the digital input signal is entered into the first and second sound image localization means every sampling time period. As a result, this DSP must process a single digital signal within a single sampling time period. For example, if the input signal is obtained by being sampled at the frequency of 48 kHz, the sampling time period becomes approximately 21 microseconds. Therefore, this DSP must perform the following process operation every approximately 21 microseconds, namely, the first localization signal is produced and weighted, and the second localization signal is produced and weighted. After all, there is another problem that the high cost DSP operable in high speeds is necessarily required in this conventional sound image localization apparatus.

SUMMARY OF THE INVENTION

As a consequence, an object of the present invention is to provide a sound image localization apparatus and a sound image localizing method, capable of localizing a sound image at an arbitrary position within a three-dimensional space with keeping a superior real-time characteristic by employing a simple/low-cost circuit, or a simple data processing operation.

Another object of the present invention is to provide a delay amount control apparatus capable of changing a delay amount in high speed without producing noise.

A further object of the present invention is to provide a sound image control apparatus capable of changing a delay amount without producing noise, and therefore capable of moving a sound image in high speed and in a smoothing manner.

To achieve the above-described objects, a sound image localization apparatus for producing a first channel signal and a second channel signal, used to localize a sound image, according to a first aspect of the present invention, comprising:

time difference signal producing means for sequentially outputting externally supplied input signals as a first time difference signal and a second time difference signal while giving an inter aural time difference corresponding to a sound image localization direction, wherein the second time difference signal is outputted as a second channel signal; and function processing means for processing the first time difference signal derived from the time difference signal producing means with employment of a relative function constituted by a ratio of a left head related acoustic transfer function to a right head related acoustic transfer function in response to the sound image localization direction, and outputting a processed signal as a first channel signal.

The respective means for constituting the sound image localization apparatus according to the first aspect of the present invention, a delay amount control apparatus according to a third aspect of the present invention (will be explained later), and a sound image control apparatus according to a fourth aspect of the present invention (will be described later) may be realized by employing a hardware, or by executing a software processing operation by a DSP, a central processing unit (CPU), and the like.

The externally supplied input signal contains, for instance, a voice signal, a music sound signal, and so on. This input signal may be formed as, for example, digital data obtained by sampling an analog signal at a preselected frequency, by quantizing the sampled signal, and further by coding this quantized sampled signal (will be referred to as "sampling data" hereinafter). This input signal is supplied from, for example, an A/D converter every sampling time period.

The time difference signal producing means may be arranged by, for instance, a delay device. To this time difference signal producing means, for example, a monaural signal may be entered as the input signal. In such a case that the first time difference signal outputted from this time difference signal producing means is used as the left channel signal, if the sound image localization direction is larger than, or equal to 0 degree and smaller than 180 degrees, then the first time difference signal is first outputted, and subsequently the second time difference signal is outputted which is delayed only by the inter aural time difference with respect to this first time difference signal. This inter aural time difference is different from each other, depending on the direction of the sound source as viewed from the audience, namely the sound image localization direction (angle).

If the sound image localization direction is larger than, or equal to 180 degrees and smaller than 360 degrees, then the second time difference signal is first outputted, and subsequently the first time difference signal is outputted which is delayed only by the inter aural time difference with respect to this second time difference signal. When the first time difference signal is used as the right channel signal, the output sequence of the first time difference signal and the second time difference signal is reversed as to the above-described output sequence.

The relative function used in the function processing means is constituted by a ratio of the left head related acoustic transfer function to the right head transfer related transfer function in the conventional sound image localization apparatus. Conceptionally speaking, this relative function may be conceived as such a function obtained by dividing each of the functions used in the left head related acoustic transfer function processor 52 and the right head related acoustic transfer function processor 53 shown in FIG. 1 by the function used in the right head related acoustic transfer function processor 53. As a result, only the first time difference signal is processed in the function processing means, and the second time difference signal is directly outputted as the second channel signal.

Since the function processing means is arranged in the above-described manner, the process operation for applying the head related acoustic transfer function only to the first time difference signal is merely carried out, and there is no need to carry out the process operation for the second time difference signal. As a consequence, when this sound image localization apparatus is arranged by, for example, hardware, a total amount of hardware can be reduced. When this sound image localization apparatus is arranged by executing software processing operation, a total calculation amount can be reduced.

Also, the image localization apparatus according to the first aspect of the present invention may be arranged by further comprising:

correcting means constructed of a filter for filtering the externally supplied input signal, a first amplifier for amplifying a signal filtered out from the filter, a second amplifier for amplifying the externally supplied input signal, and an adder for adding an output signal from the first amplifier to an output signal from the second amplifier, wherein the correcting means controls gains of the first amplifier and of the second amplifier to thereby correct sound qualities and sound volumes of sounds produced based upon the first channel signal and the second channel signal. This correcting means may be provided at a prestage, or a poststage of the time difference signal producing means. Preferably, this correcting means is provided at the prestage of the time difference signal producing means.

In the sound image localization apparatus according to the first aspect of the present invention, the relative function made of the ratio of the left head related acoustic transfer function to the right head related acoustic transfer function is utilized as the head related acoustic transfer function used to localize the sound image. As a result, in such a case that the sound image is localized near the 90-degree direction and the 270-degree direction where the ratio of the right/left head related acoustic transfer functions is large, the sound quality is greatly changed. On the other hand, in such a case that the sound image is localized near the 0-degree direction and the 180-degree direction where the ratio of the right/left head related acoustic transfer functions is small, no clear discrimination can be made as to whether the sound image is localized in the front direction (namely, 0-degree direction), or in the rear direction (namely, 180-degree direction). Therefore, unnatural feelings still remain. To solve such a problem, the correcting means corrects the input signal so as to achieve such a frequency characteristic close to the original frequency characteristic, so that a change in the sound quality can be suppressed. Also, since the sound volume is excessively increased near the 90-degree direction and the 270-degree direction, the correcting means corrects the sound volume in order to obtain uniform sound volume feelings. Since such a sound volume correction is carried out, unnatural feelings in the sound qualities and sound volume can be removed.

The respective gains of the first amplifier and the second amplifier contained in this correcting means may be controlled based upon data calculated in accordance with a preselected calculation formula. In this case, as this preselected calculation formula, a linear function prepared for each of these first and second amplifiers may be employed. According to this arrangement, the data used to control the respective gains of the first amplifier and the second amplifier need not be stored every sound image localization direction, so that a storage capacity of a memory can be reduced. This memory should be provided in an apparatus to which this sound image control apparatus is applied.

Also, the image localization apparatus according to the first aspect of the present invention may be arranged by further comprising:

time difference data producing means for producing inter aural time difference data in accordance with a preselected calculation formula, the inter aural time difference data is used to produce an inter aural time difference in response to the sound image localization direction, wherein the time difference signal producing means sequentially outputs the first time difference signal and the second time difference signal, while giving an inter aural time difference corresponding to the inter aural time difference data produced by the time difference data producing means.

Above-described function processing means may include:

a plurality of fixed filters into which the first time difference signal is inputted;

a plurality of amplifiers for amplifying signals filtered out from the respective fixed filters; and an adder for adding signals derived from the plurality of amplifiers to each other, wherein the function processing means controls each of gains of the plural amplifiers to simulate the relative function.

In this case, second order IIR type filters may be used as the plurality of fixed filters.

Also, to achieve the above-described objects, a sound image localizing method, according to a second aspect of the present invention, comprising the steps of:

sequentially outputting externally supplied input signals as a first time difference signal and a second time difference signal while giving an inter aural time difference corresponding to a sound image localization direction;

processing the first time difference signal by employing a relative function made of a ratio of a left head related acoustic transfer function to a right head related acoustic transfer function in response to the sound image localization direction, whereby a first channel signal is produced; and localizing a sound image based upon the first channel signal and the second time difference signal functioning as a second channel signal.

This sound image localizing method may be arranged by further comprising the step of:

adding a signal obtained by filtering the externally supplied input signal and amplifying the filtered input signal to another signal obtained by amplifying the externally supplied input signal, wherein sound qualities and sound volumes of sounds produced based on the first channel signal and the second channel signal are corrected by controlling gains of both the amplification for the filtered input signal and the amplification for the externally supplied input signal. In this case, the gains of the amplification for the filtered input signal and of the amplification for the externally supplied input signal may be determined in accordance with a predetermined calculation formula.

Also, the sound image localizing method may be arranged by further comprising the step of:

producing inter aural time difference data used to produce an inter aural time difference corresponding to the sound image localization direction in accordance with a preselected calculation formula, wherein in the outputting step , the first time difference signal and the second time difference signal are sequentially outputted while giving an inter aural time difference corresponding to the inter aural time difference data produced at the time difference data producing step.

Above-described step for producing the first channel signal may include:

filtering the first time difference signal by using a plurality of fixed filters, amplifying each of the filtered first time difference signals, and adding the amplified first time difference signals, whereby the relative function may be simulated by controlling the gains of the amplification for the filtered input signal and of the amplification for the externally supplied input signal.

Also, to achieve the above-described objects, a delay amount control apparatus for delaying an externally supplied input signal based on an externally supplied delay coefficient to output a delayed input signal, according to a third aspect of the present invention, comprising:

delay amount detecting means for detecting as to whether or not the delay coefficient is changed;

delay amount saving means for saving a delay coefficient before being changed when the delay amount detecting means detects that the delay coefficient is changed;

delay means for outputting a first delay signal produced by delaying the externally supplied input signal by delay amount designated by the delay coefficient before being changed, which is saved in the delay amount saving means, and also a second delay signal produced by delaying the externally supplied input signal by a delay amount designated by the externally supplied delay coefficient; and cross-fade mixing means for cross-fading the first delay signal and the second delay signal outputted from the delay means so as to mix the first delay signal with the second delay signal.

The delay means may be constructed of, for instance, a memory. This memory sequentially stores sampling data corresponding to the externally entered input signals. In this case, the delay coefficient used to designate the delay amount may be constituted by an address used to read the sampling data from this memory. The delay amount is determined based on this address value. It should also be noted that the delay means may be constituted by a delay line element provided outside the DSP. In this case, the delay coefficient is used to select the output tap of this delay line element.

The delay amount saving means saves, for instance, an address as a delay coefficient before being changed. The cross-fade mixing means cross-fade-mixes the sampling data sequentially read out from the memory in response to the addresses saved in this delay amount saving means, and the sampling data sequentially read out from the memory in response to the newly applied address. In other words, the first delay signal delayed only by the delay amount designated by the delay coefficient before being changed is cross-fade-mixed with the second delay signal delayed only by the delay amount designated by the delay coefficient after being changed.

The above-described cross-fade mixing means may sequentially add the first delay signal decreased within a preselected time range to the second delay signal increased within the preselected time range. Concretely speaking, the first delay signal is multiplied by a coefficient "B" which is decreased while time has passed, and the second delay signal is multiplied by another coefficient (1-B) which is increased while time has passed. Then, the respective multiplied results are added to each other. In this case, the respective coefficient values are selected in such a manner that the addition result obtained by adding the coefficient B to the coefficient 1-B continuously becomes a constant value (for instance "1"). Even when the delay coefficient is changed, since the input signal is outputted which has been delayed only by the gently changed delay amount by way of this cross-fade mixing operation, no discontinuous point is produced in the signal. As a consequence, no noise is produced.

Also, to achieve the above-described objects, a sound image control apparatus for producing sounds in response to a first channel signal and a second channel signal so as to localize a sound image, according to the fourth aspect of the present invention, comprising:

delay amount control means for delaying an externally supplied input signal based upon a delay coefficient indicative of an inter aural time difference corresponding to a second image localization direction to thereby output the delayed externally supplied input signal;

first function processing means for processing the input signal in accordance with a first head related acoustic transfer function to thereby output the processed input signal as the first channel signal; and second function processing means for processing the delayed input signal derived from the delay amount control means in accordance with a second head related acoustic transfer function to thereby output the processed delayed input signal as the second channel signal, wherein the delay amount control means is composed of:

delay amount detecting means for detecting as to whether or not the delay coefficient is changed;

delay amount saving means for saving a delay coefficient before being changed when the delay amount detecting means detects that the delay coefficient is changed;

delay means for outputting a first delay signal produced by delaying the externally supplied input signal by a delay amount designated by the delay coefficient before being changed, which is saved in the delay amount saving means, and also a second delay signal produced by delaying the externally supplied input signal by a delay amount designated by the externally supplied delay coefficient; and cross-fade mixing means for cross-fading the first delay signal and the second delay signal outputted from the delay means so as to mix the first delay signal with the second delay signal.

This sound image control apparatus may be arranged by further comprising:

storage means for storing therein both a delay coefficient and an amplification coefficient in correspondence with a sound image localization direction, wherein when the sound image localization direction is externally designated, the delay coefficient read from the storage means is supplied to the delay amount detecting means and the delay means included in the delay amount control means.

In this sound image control apparatus, each of the first function processing means and the second function processing means may include:

a plurality of fixed filters for filtering inputted signals with respect to each of frequency bands;

a plurality of amplifiers for amplifying signals filtered out from the respective fixed filters; and an adder for adding signals amplified by the plurality of amplifiers, wherein each of gains of the plural amplifiers is controlled so as to simulate the first and second head related acoustic transfer functions. In this case, second order IIR type filters may be used as the plurality of fixed filters.

Also, the sound image control apparatus may be arranged by further comprising:

storage means for storing therein both a delay coefficient and an amplification coefficient in correspondence with a sound image localization direction, wherein when the sound image localization direction is externally designated, the amplification coefficient read from the storage means is supplied to the amplifiers included in the first function processing means and the second function processing means.

BRIEF DESCRIPTION OF THE DRAWINGS

For a better understanding of the present invention, reference may be made to the accompanying drawings, in which:

FIG. 21 including

FIG. 21A indicates an externally supplied delay coefficient;

FIG. 21B shows a delay amount change detection signal A;

FIG. 21C denotes a delay coefficient before being changed;

FIG. 21D shows a first cross-fade coefficient B;

FIG. 21E indicates a second cross-fade coefficient 1-B;

DESCRIPTION OF THE PREFERRED EMBODIMENTS

EMBODIMENT MODE 1

Figure 3:
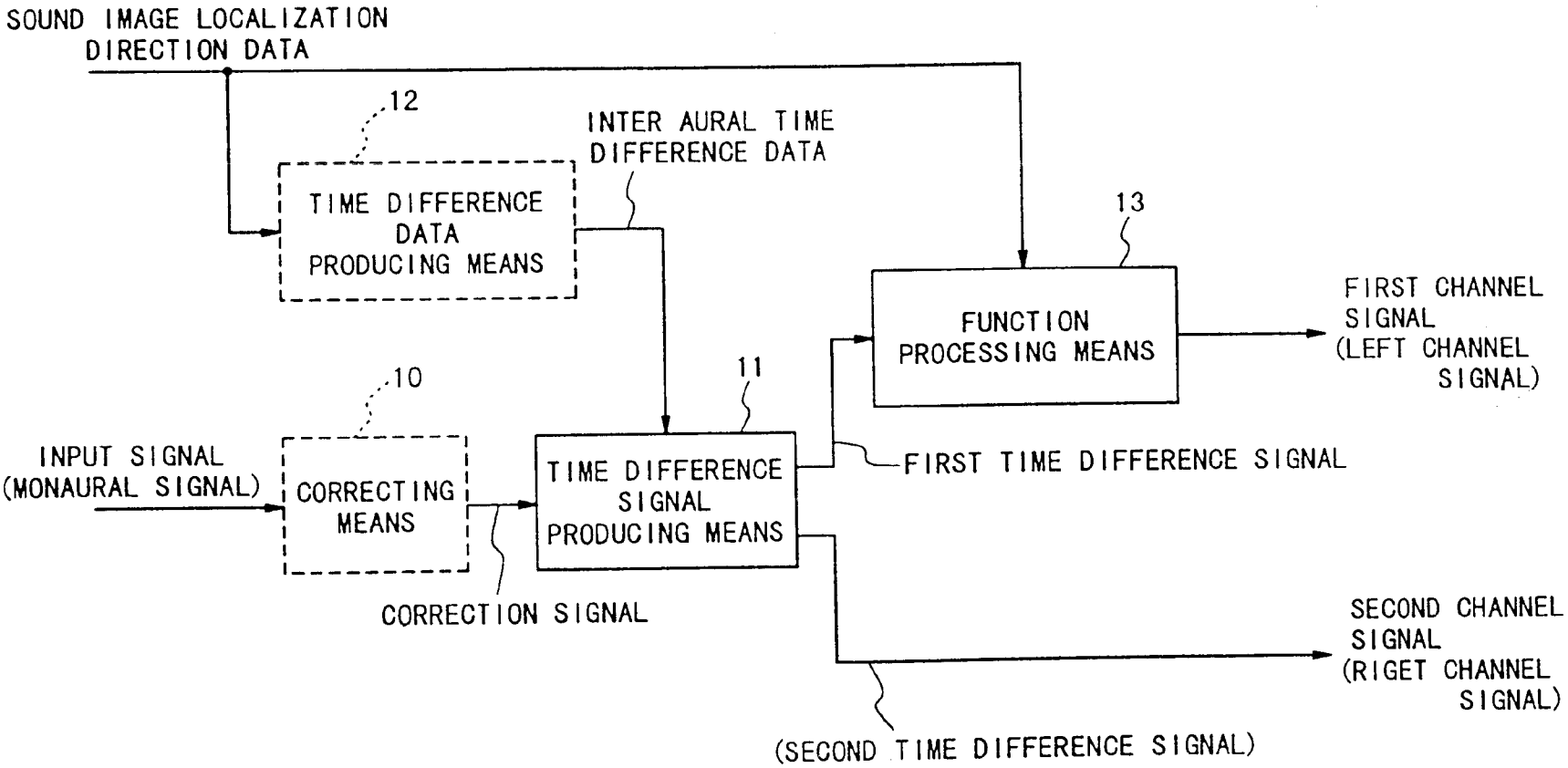
FIG. 3 is a schematic block diagram for indicating an arrangement of a sound image localization apparatus according to the present invention.

FIG. 3 is a schematic block diagram for showing an arrangement of a sound image localization apparatus according to an embodiment mode 1 of the present invention.

It should be understood that although both time difference data producing means 12 and correcting means 10 indicated by a dotted line of FIG. 3 are optionally provided, the sound image localization apparatus according to this embodiment 1 is equipped with these time difference data producing means 12 and correcting means 10. It should be understood that the above-described means are realized by performing a software process operation by a DSP. Also, it should be noted that an input signal externally supplied to this sound image localization apparatus is a monaural signal, and is furnished from a tone generator (not shown). Further, it is now assumed that sound image localization direction data is supplied from a CPU (Central Processing Unit) (not shown) which is employed so as to control this sound image localization apparatus. Moreover, it is assumed that a first channel signal corresponds to a left channel signal, and a second channel signal corresponds to a right channel signal.

After the externally supplied input signal is processed by the correcting means 10 capable of correcting a sound quality and a sound volume, the processed input signal is supplied as a correction signal to time difference signal producing means 11. This correcting means 10 will be described more in detail later.

The time difference signal producing means 11 is constructed of, for instance, a delay device. This time difference signal producing means 11 enters the correction signal from the correcting means 10 to thereby output a first time difference signal and a second time difference signal. Each of waveforms related to the first time difference signal and the second time difference signal is identical to a waveform of the correction signal. However, any one of these first and second time difference signals is delayed by an inter aural time difference in response to inter aural time difference data derived from the time difference data producing means 12 to output a delayed time difference signal. That is, the inter aural time difference data may determine which time difference signal is selected and how much the selected time difference signal is delayed.

Figure 4:
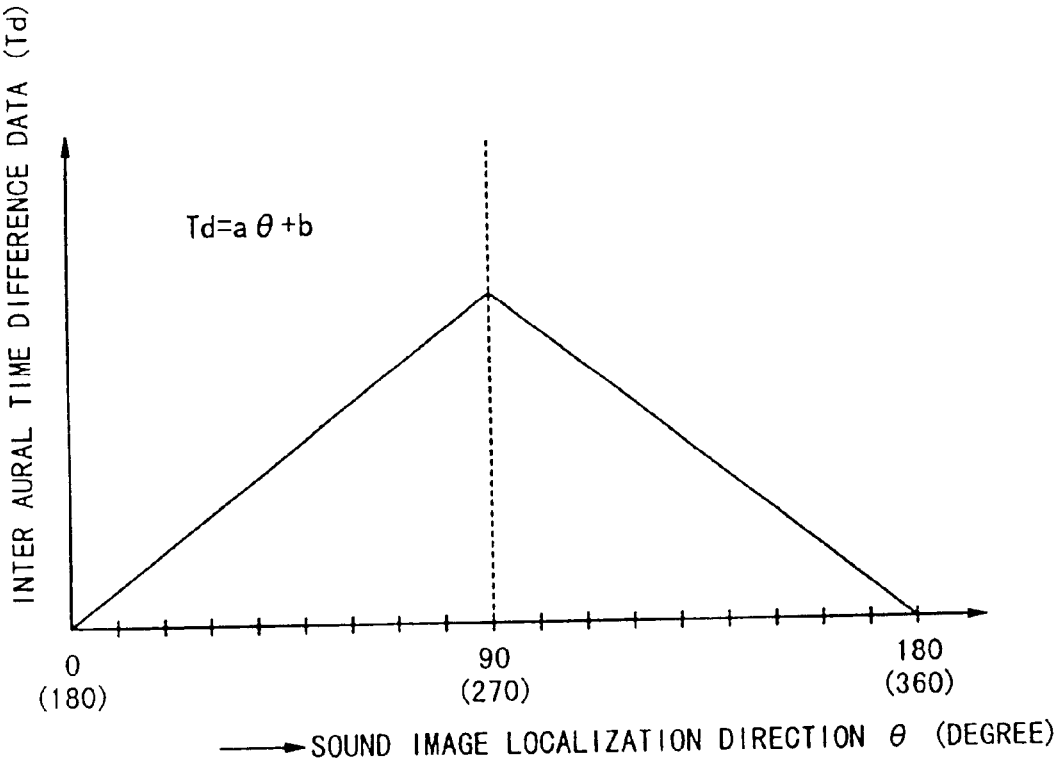
FIG. 4 is a diagram for representing a relationship between a sound image localization direction and an inter aural time difference in the sound image localization apparatus of FIG. 3.

The time difference data producing means produces the inter aural time difference data which are different from each other in response to the sound image localization directions. The inter aural time difference data may be calculated by using, for instance, the below-mentioned formula (1):

$$G(s)_{LPFI} = \frac{\omega_{LPFI}}{s + \omega_{LPFI}} \qquad \text{formula (7)}$$

$$f_{LPFI} = \frac{\omega_{LPFI}}{2\pi} = 1 \text{ kHz}$$

Where symbol "Td" indicates the inter aural time difference data, symbol "θ" denotes the sound image localization direction (angle), and symbols "a" and "b" are constants. When the sound image localization angles (directions) "θ" are defined by 0 degree ≦θ<90 degrees and 180 degrees ≦θ<270 degrees, the constant "a" is positive and the constant "b" is equal to zero, or near zero. When the sound image localization angles "θ" are defined by 90 degrees ≦θ<180 degrees and 270 degrees ≦θ<360 degrees, the constant "a" is negative and the constant "b" is equal to a preselected positive value. FIG. 4 graphically represents a relationship between the sound image localization direction "θ" and the inter aural time difference data "Td", which can satisfy the above-explained condition.

The constants "a" and "b" defined in the formula (1) can be obtained in such a manner that head impulse responses with respect to various sound image localization directions are actually measured, and the actually measured head impulse responses are approximated in accordance with a predetermined manner. It should be understood that the inter aural time difference data "Td" may be theoretically expressed by the following formula (2):

$$Td = c.\ \sin\theta \qquad \text{formula (2)}$$

where symbol "c" shows a preselected constant.

To confirm validity of the above-explained formula (1), the Inventors of the present invention made the following experiment. That is, a first time difference signal and a second time difference signal were produced by employing the inter aural time difference data calculated based upon the above-described formula (1), and the inter aural time difference data calculated based on the above-explained formula (2). Musical sounds were generated in response to these first and second time difference signals respectively so as to be acoustically compared with each other. Eventually, the Inventors could not recognize any acoustic difference between these musical sounds. As a consequence, in the sound image localization apparatus of this embodiment mode 1, the inter aural time difference data is calculated by using the linear function shown in the formula (1). Accordingly, a processing amount by the DSP for calculating the inter aural time difference data can be reduced, as compared with another processing amount by the DSP for calculating the inter aural time difference data by employing the function shown in the formula (2). Alternatively, the sound image localization apparatus may be arranged by producing the inter aural time difference data with employment of the function defined in the above-described formula (2).

In the case that the sound image localization direction "θ" is defined by 0 degree ≦θ<180 degrees, the time difference signal producing means 11 directly outputs a correction signal as the first time difference signal, and also outputs another correction signal which is delayed by the inter aural time difference data Td as the second time difference signal. Similarly, when the sound image localization direction "θ" is defined by 180 degrees ≦θ<360 degrees, the time difference signal producing means 11 directly outputs a correction signal as the second time difference signal, and also outputs another correction signal which is delayed by the inter aural time difference data Td as the first time difference signal. In any cases, the delay time is determined in accordance with the above-explained formula (1). The first time difference signal produced from this time difference signal producing means 11 is supplied to function processing means 13, and the second time difference signal is externally outputted as a right channel signal.

Figure 5:
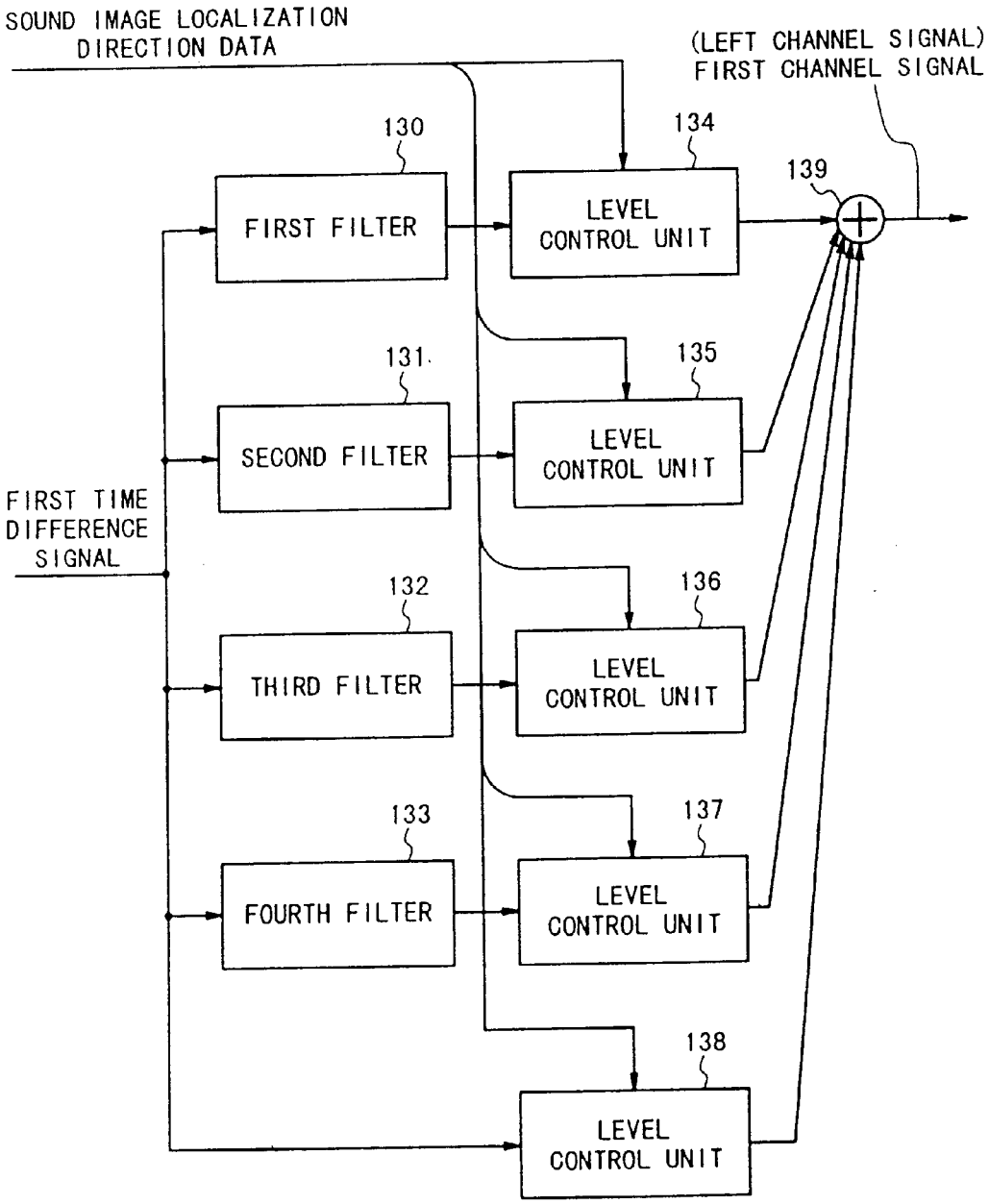
FIG. 5 is a schematic block diagram for showing an arrangement of a function processing means employed in the sound image localization apparatus shown in FIG. 3.

The function processing means 13 is arranged by filters 130 to 133, level control units 134 to 138, and an adder 13, as indicated in FIG. 5, as an example. In FIG. 5, the first filter 130, the second filter 131, and the third filter 132 are band-pass filters, whereas the fourth filter 133 is a high-pass filter. The respective filters are arranged by second order IIR type filters. The first time difference signal is inputted to these filters 130 to 133.

The level control unit 134 controls a level of a signal derived from the first filter 130 in accordance with the corresponding sound image localization direction data. Also, the level control unit 135 controls a level of a signal supplied from the second filter 131 in accordance with the corresponding sound image localization direction data. The level control unit 136 controls a level of a signal derived from the third filter 132 in accordance with the corresponding sound image localization direction data. Also, the level control unit 137 controls a level of a signal supplied from the fourth filter 133 in accordance with the corresponding sound image localization direction data. Further, the level control unit 138 controls the level of the first time difference signal in accordance with the sound image localization direction data. The respective level control units 134 to 138 correspond to amplifies of the present invention, and are arranged by, for instance, multipliers.

The adder 139 adds the respective signals outputted from the first to fourth level control units 134 to 138. An added signal result is externally outputted as a left channel signal (namely, first channel signal).

Figure 6:
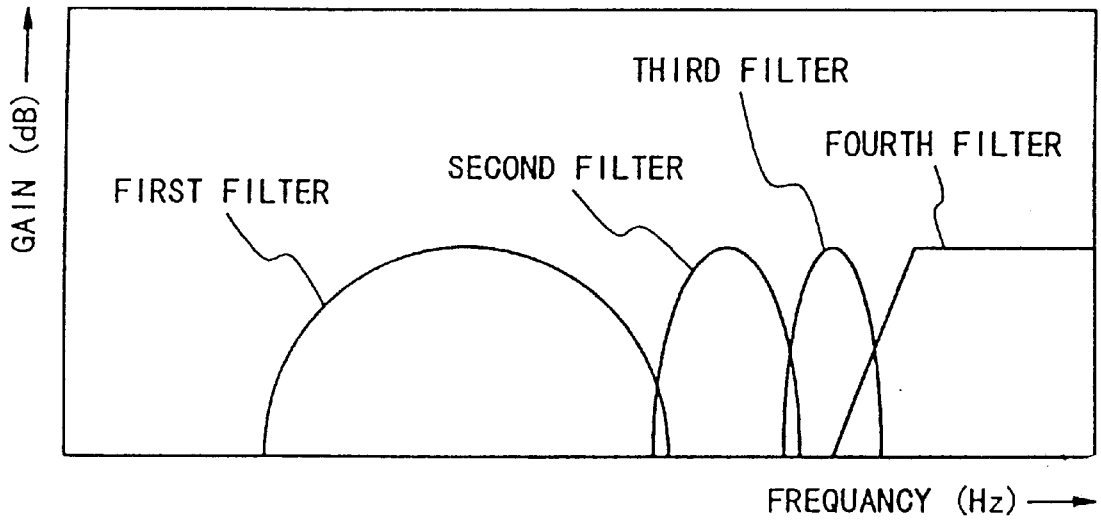
FIG. 6 graphically shows a characteristic of a filter used in the function processing means shown in FIG. 5.
Figure 7:
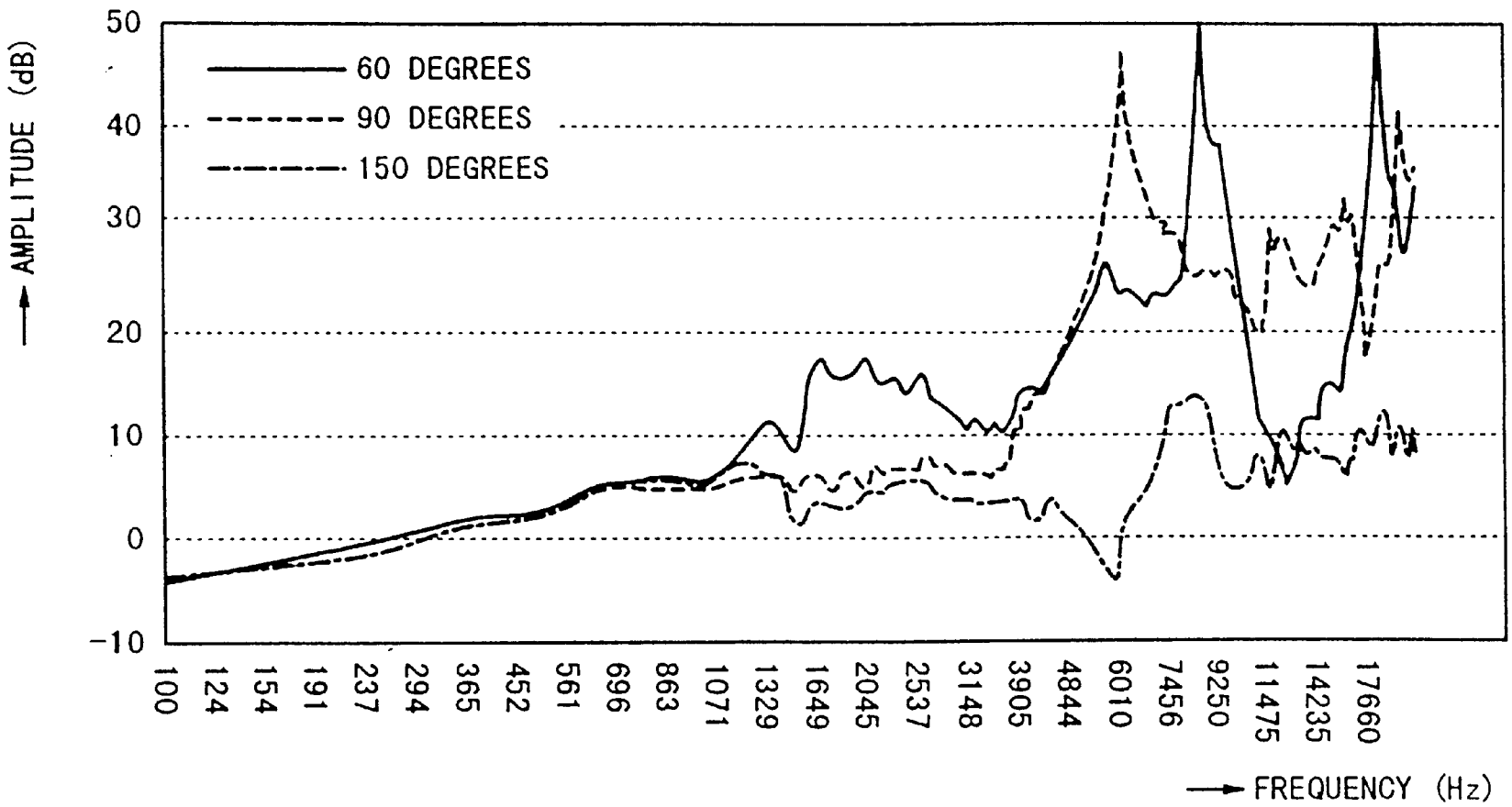
FIG. 7 graphically indicates a frequency characteristic of the function processing means shown in FIG. 5.

FIG. 6 is a graphic representation for schematically showing filter characteristics of the first to fourth filters 130 to 133. The characteristics of the respective filters 130 to 133 are determined in the following manner. First, a frequency characteristic of a relative function is analyzed. An example of the frequency characteristic of this relative function is shown in FIG. 7. In FIG. 7, there are represented such frequency characteristics in the case that the sound image localization directions are selected to be 60 degrees, 90 degrees, and 150 degrees. The following acts can be understood from the frequency characteristics of FIG. 7.

1) A dull peak appears around 1.5 kHz. In particular, peak having amplitude of approximately 20 dB appears at 60 degrees of the sound image localization direction.

2) A great peak appears around 5 kHz at 90 degrees, and a relatively great peak appears at 60 degrees. However, conversely, a dip appears at 150 degrees.

3) Another great peak appears around 8 kHz at 60 degrees, whereas no peak appears at 90 degrees. A small peak is produced at 150 degrees.

4) A dip is produced around 10 kHz at 60 degrees, and the frequency characteristic is smoothly changed at 90 degrees and 150 degrees.

From the foregoing descriptions, it is conceivable that the four sorts of frequencies such as 1.5 kHz, 5 kHz, 8 kHz, and higher than 10 kHz are extensively related to the sound image localization direction (degrees). On the other hand, substantially no change is present in the frequencies lower than, or equal to 1 kHz. Even when the frequency characteristics at other angles are observed, there is no change in the above-described trend. As previously explained, the peaks and the dips appear in the vicinity of the above described four sorts of frequencies.

Considering the above-described trend, filters having the below-mentioned filter characteristics have been employed as the first filter 130 to the fourth filter 133. That is, as the first filter 130, a band-pass filter having a frequency characteristic expressed by a function $G(s)_{BPF1}$ is employed. The function $G(s)_{BPF1}$ is defined in the below-mentioned formula (3):

$$G(s)_{BPF1} = \frac{2\zeta_{BPF1}\omega_{BPF1}}{s^2 + 2\zeta_{BPF1}\omega_{BPF1} + \omega_{BPF1}^2} \quad \text{formula (3)}$$

$$\zeta_{BPF1} = 0.5$$

$$f_{BPF1} = \frac{\omega_{BPF1}}{2\pi} = 1.5 \text{ kHz}$$

where symbol "s" indicates the Laplacean, symbol "$\omega_{BPF1}$" is an angular frequency, symbol $\zeta_{BPF1}$ denotes a damping coefficient ($\zeta$=1/2Q), and symbol "$f_{BPF1}$" shows a center frequency of the band-pass filter.

As the second filter 131, a band-pass filter having a frequency characteristic expressed by a function $G(S)_{BPF2}$ is employed. The function $G(s)_{BPF2}$ is defined in the below-mentioned formula (4):

$$G(s)_{BPF2} = \frac{2\zeta_{BPF2}\omega_{BPF2}}{s^2 + 2\zeta_{BPF2}\omega_{BPF2} + \omega_{BPF2}^2} \quad \text{formula (4)}$$

$$\zeta_{BPF2} = 0.2$$

$$f_{BPF2} = \frac{\omega_{BPF2}}{2\pi} = 5 \text{ kHz}$$

where symbol "s" indicates the Laplacean, symbol "$\omega_{BPF2}$" is an angular frequency, symbol $\zeta_{BPF2}$ denotes a damping coefficient, and symbol "$f_{BPF2}$" shows a center frequency of the band-pass filter.

As the third filter 132, a band-pass filter having a frequency characteristic expressed by a function $G(s)_{BPF3}$ is employed. The function $G(s)_{BPF3}$ is defined in the below-mentioned formula (5):

$$G(s)_{BPF3} = \frac{2\zeta_{BPF3}\omega_{BPF3}}{s^2 + 2\zeta_{BPF3}\omega_{BPF3} + \omega_{BPF3}^2} \quad \text{formula (5)}$$

$$\zeta_{BPF3} = 0.15$$

$$f_{BPF3} = \frac{\omega_{BPF3}}{2\pi} = 8 \text{ kHz}$$

where symbol "s" indicates the Laplacean, symbol "$\omega_{BPF3}$" is an angular frequency, symbol $\zeta_{BPF3}$ denotes a damping coefficient, and symbol "$f_{BPF3}$" shows a center frequency of the band-pass filter.

As the fourth filter 133, a high-pass filter having a frequency characteristic expressed by a function $G(s)_{HPF1}$ is employed. The function $G(s)_{HPF1}$ is defined in the below-mentioned formula (6):

$$G(s)_{HPF1} = \frac{s^2}{s^2 + 2\zeta_{HPF1}\omega_{HPF1} + \omega_{HPF1}^2} \quad \text{formula (6)}$$

$$\zeta_{HPF1} = 0.4$$

$$f_{HPF1} = \frac{\omega_{HPF1}}{2\pi} = 10 \text{ kHz}$$

where symbol "s" indicates the Laplacean, symbol "$\omega_{HPF1}$" is an angular frequency, symbol $\zeta_{HPF1}$ shows a damping factor, and symbol "$f_{HPF1}$" is a cut-off frequency of this high-pass filter.

The function processing means 13 controls the levels of the respective signals derived from the four sets of filters 130 to 133 having the above-described characteristics in accordance with the sound image localization directions to thereby simulate the relative function. The above-described level controls are carried out in the corresponding level control units 134 to 137. Next, a description will now be made of a method for determining the levels of the respective signals in accordance with the sound image localization directions in the respective level control units 134 to 138. In the following descriptions, the level at the level control unit 134 is referred to as a "level 1", the level at the level control unit 135 is referred to as a "level 2", - - - , the level at the level control unit 138 is referred to as a "level 5". It is now assumed that the values of the respective levels are such values in a range from "0" to "1".

Figure 8:
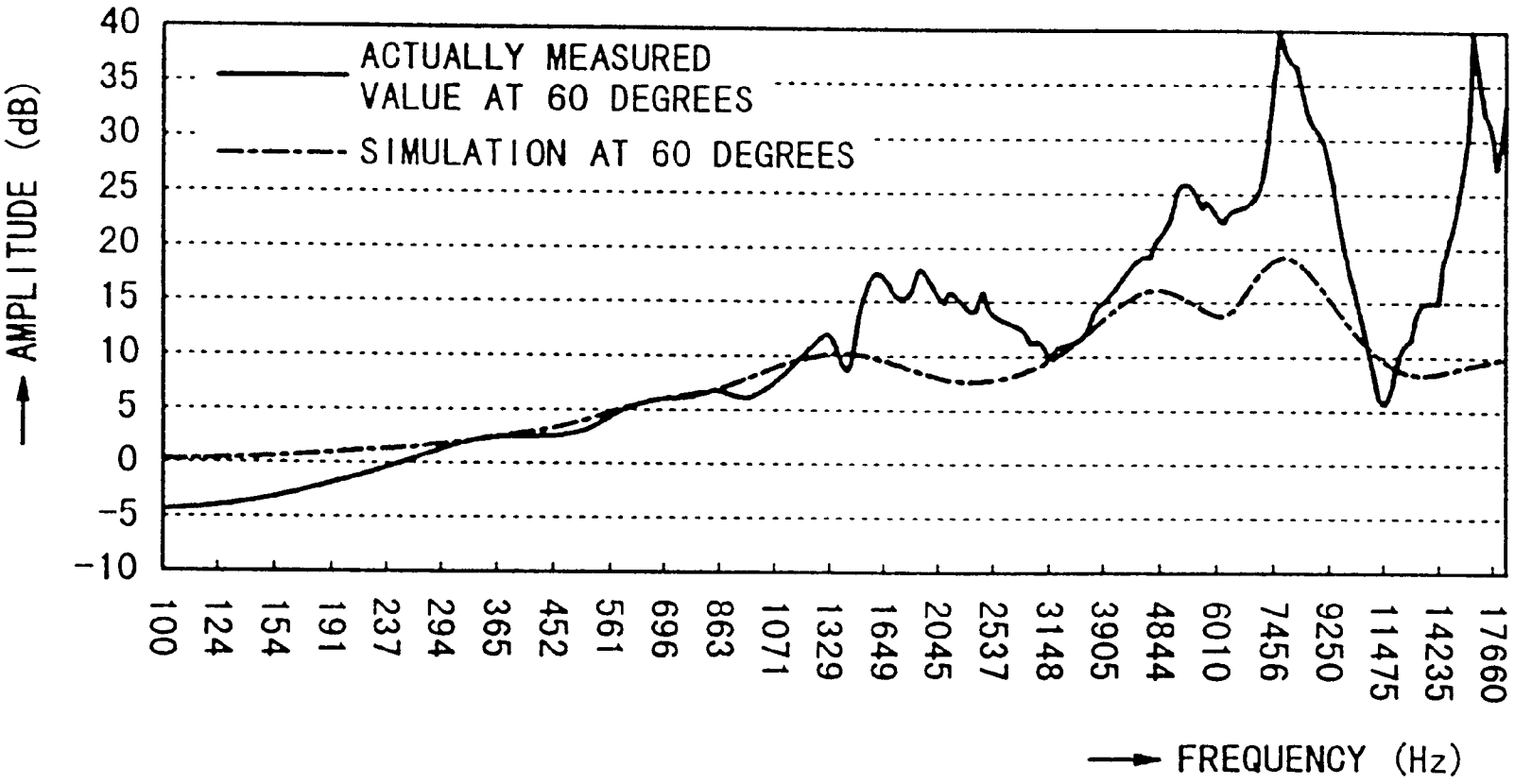
FIG. 8 graphically shows an actually measured value and a simulation value of the frequency characteristic of the function processing means shown in FIG. 5 in the case that the sound image localization direction is selected to be 60 degrees.

The levels of the respective signals derived from the first filter 130 to the fourth filter 138 and of the first time difference signal are determined in accordance with the following manner. That is to say, a characteristic of a relative function is previously and actually measured, and the sound image localization direction data supplied to the level control units 134 to 138 are controlled so as to be approximated to this actually measured characteristic. FIG. 8 graphically represents an actually measured characteristic and a simulated characteristic in the case that the sound image localization direction is selected to be 60 degrees. In the simulation case, the calculations are carried out under conditions of level 1 =0.18; level 2=0.3; level 3=0.6; level 4=0.3; and level 5=0.1. At the frequencies of 5 kHz and 8 kHz, the levels are set to be low, as compared with those of the actual measurement case. Thus, there is such a trend that the sound image is localized outside the head of the audience, as compared with such a case that the levels are approximated to those of the actual measurement case.

Figure 9:
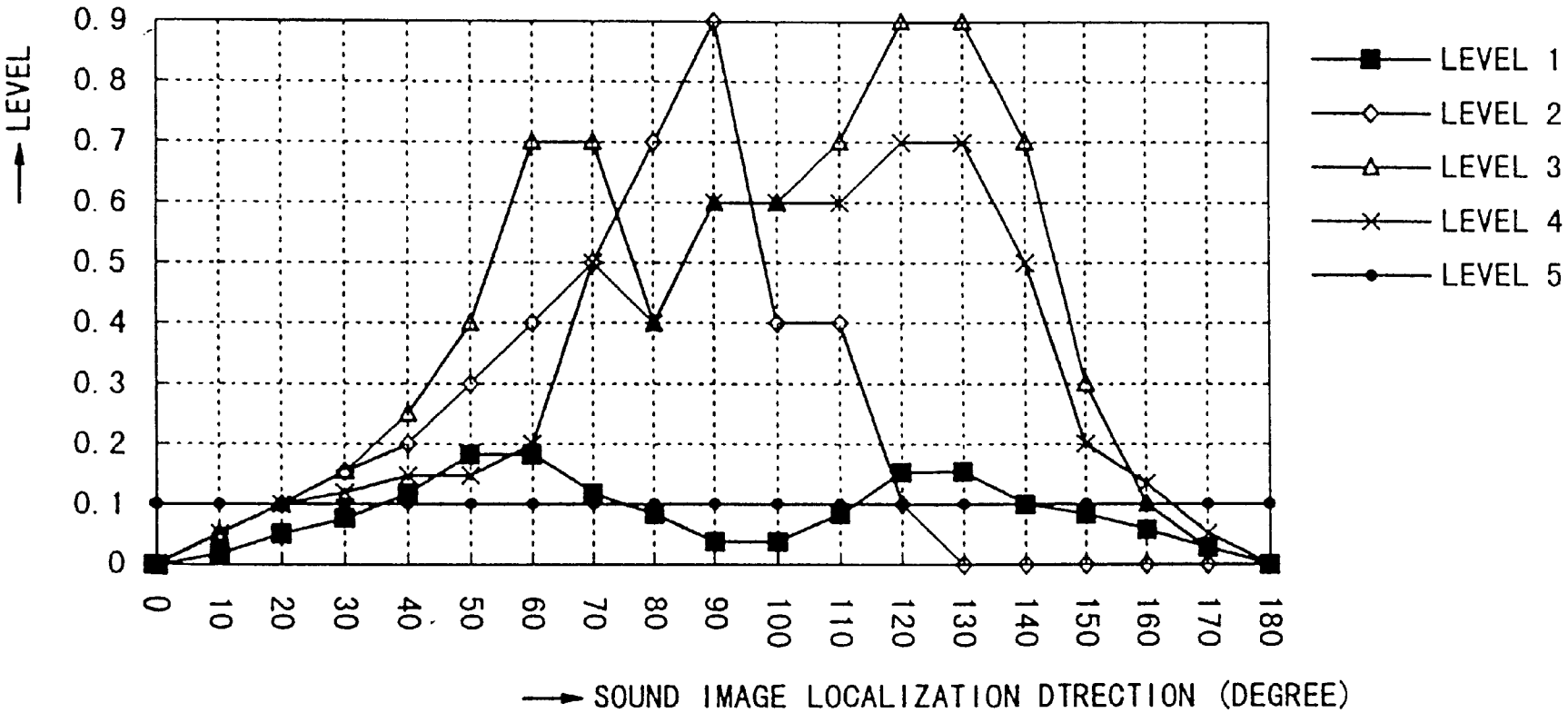
FIG. 9 graphically represents a relationship between levels and the respective sound image localization directions of the function processing means shown in FIG. 5.

Similar to the above-described manner, the levels defined in the level control units 134 to 138 with respect to the respective sound image localization directions are represented in FIG. 9. It should be noted that although the sound image localization directions are indicated from 0 degree to 180 degrees, a similar level determination result may be obtained in such a case that the sound image localization direction are selected from 180 degrees to 360 degrees. As apparent from FIG. 9, there are the below-mentioned trends in the respective levels. That is, 1) At the level 1 (1.5 kHz), while using a position of 90 degrees as a symmetrical axis, such a characteristic having a shape of a reversed character "W" is obtained.

2) At the level 2 (5 kHz), while a position of 90 degrees appears as a peak, a characteristic having a shape of a "mountain" is obtained. It should be noted that the level after 130 degrees becomes 0.

3) At the level 3 (8 kHz), while a position of 60 degrees and a position of 130 degrees appear as peaks, a characteristic having a shape of "two mountains" is obtained.

4) Since the level 5 (direct) corresponds to the reference level, all levels are set to 0.1.

Figure 10:
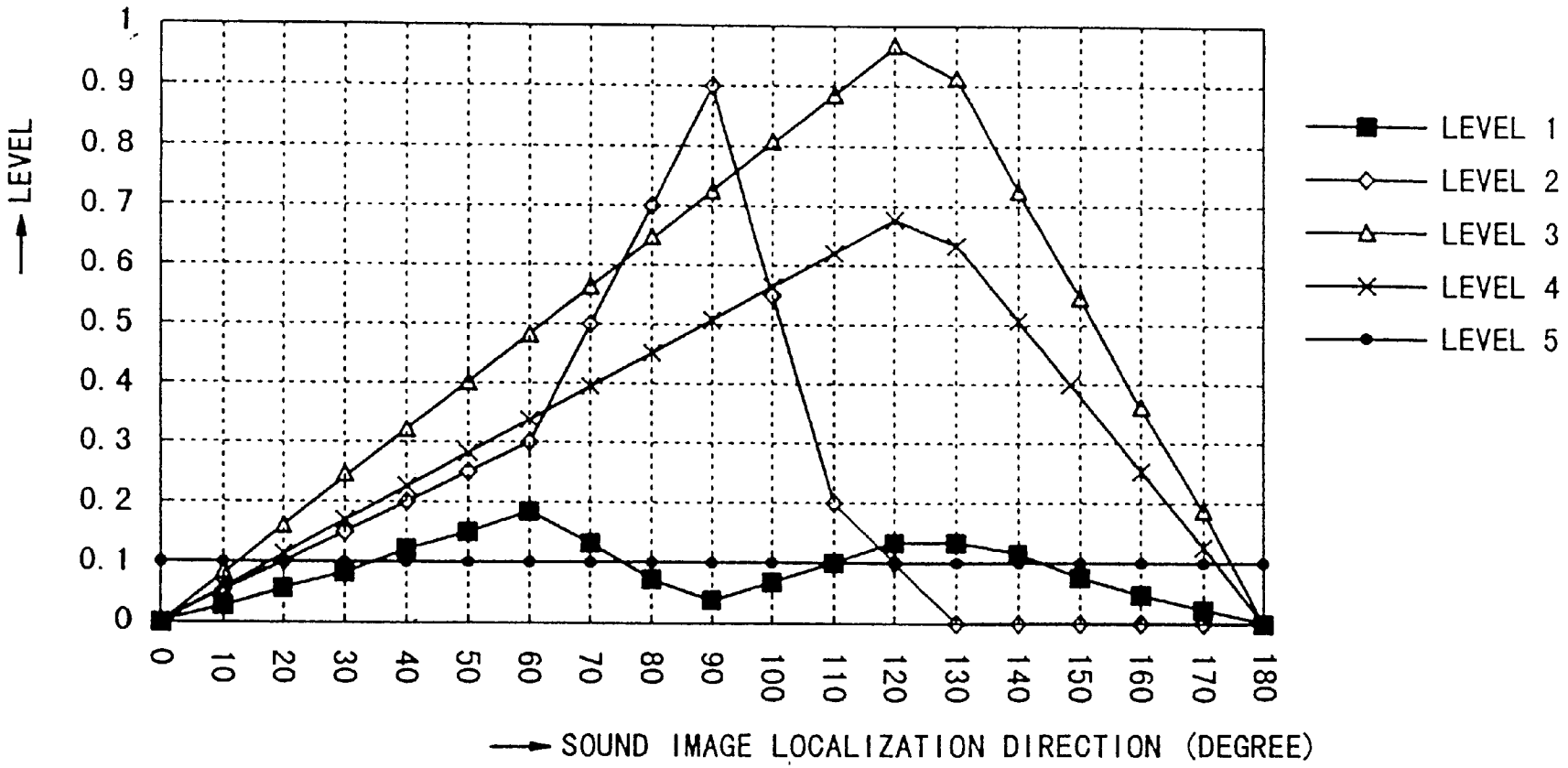
FIG. 10 illustrates such a case that the relationship between the levels and the sound image localization directions of FIG. 9 is approximated by a linear function.

As easily understood from these trends, if the sound image localization direction is subdivided into a plurality of ranges, then the relationships between the sound image localization directions and the levels may be approximated by using the linear function as to each of the ranges. The above-described relationship between the sound image localization direction and the level shown in FIG. 9 is approximated by using the linear function, and this approximated relationship is shown in FIG. 10. For instance, at the level 3, the sound image localization direction is subdivided into a range between 0 and 125 degrees and another range between 125 degrees and 180 degrees, each of which ranges is approximated by using the linear function.

With employment of such an arrangement, in the CPU for controlling this sound image localization apparatus, the sound image localization direction data (multiplication coefficient) supplied to the level control units 134 to 138 are no longer required to be stored every sound image localization direction. In other words, when the sound image localization direction is designated, the data used to determine the level is calculated by employing the linear function corresponding to this designated sound image localization direction. Then, since the calculated data can be supplied to the sound image localization apparatus, a total amount of such data used to control the sound image localization position can be reduced.

As previously described, since the filter characteristics of the first to fourth filters 130 to 133 are preset, fixed filters may be employed as these filters. As a consequence, since the filter coefficients need not be replaced, it is possible to provide the sound image localization apparatus capable of having the superior real time characteristic. It should also be noted that although the relative function is simulated by employing the four filters in this embodiment mode 1, the total number of these filters is not limited to 4, but may be selected to be an arbitrary number.

Next, the correcting means 10 will now be described. The reason why this correcting means 10 is employed in this sound image localization apparatus is given as follows. That is, since the relative function constructed of the ratio of the right head related acoustic transfer function to the left head related acoustic transfer function is used in the function processing means 13, a large change in the sound quality appears near the 90-degree direction where the ratio of the right head related acoustic transfer function to the left head related transfer function becomes large. For instance, when observing the graphic representation of FIG. 9 or FIG. 10, at the level 2 (5 kHz) and the level 3 (8 kHz), the sound volumes are increased where the sound image localization directions are 60 degrees to 140 degrees. This indicates that the sound volume in the high frequency range is excessively increased. As a result, high-frequency range emphasized sounds are produced. On the other hand, near the sound image localization directions of 0 degree and 180 degrees where the ratio of the right head related acoustic transfer function to the left head related acoustic transfer function is substantially equal to zero, the audience cannot discriminate such a case that the sound image is localized along the front direction (namely, 0-degree direction) from such a case that the sound image is localized along the rear direction (namely, 180-degree direction). To avoid these problems, the sound quality is corrected by this correcting means 10 in order to approximate the overall frequency characteristic to the original frequency characteristic. Also, near the 90-degree direction where the ratio of the right head related acoustic transfer function to the left head related acoustic transfer function is large, the sound volume is increased. To solve this problem and to achieve uniform sound volume feelings, the sound volume is corrected by this correcting means 10.

Figure 11:
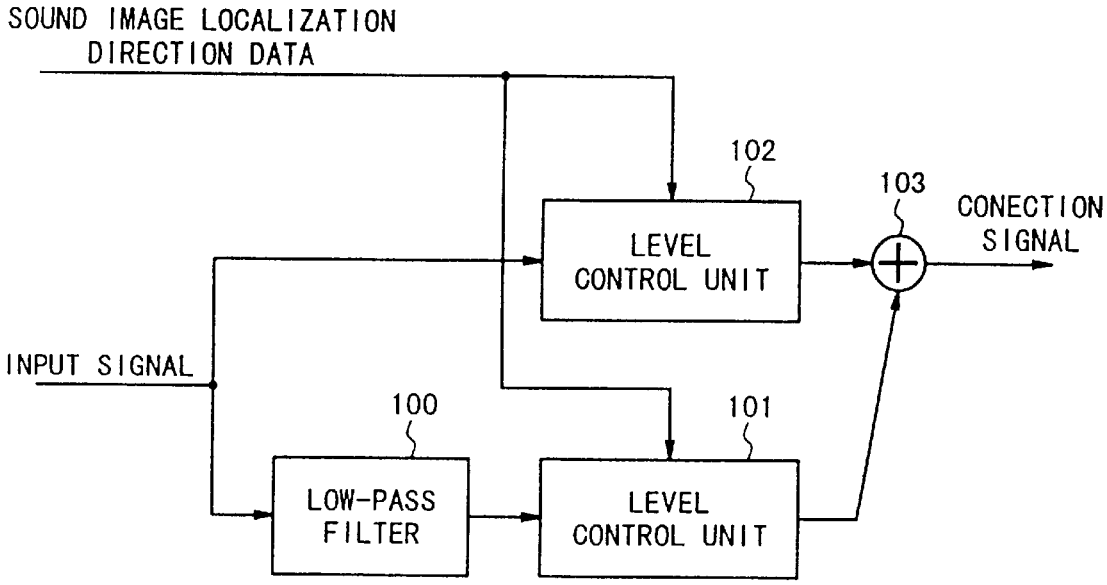
FIG. 11 is a schematic block diagram for showing an arrangement of a correcting means employed in the sound image localization apparatus shown in FIG. 3.

The correcting means 10 is constituted by, as indicated in FIG. 11 as an example, a low-pass filter 100, level control units 101 and 102, and an adder 103. An input signal is supplied to the low-pass filter 100 and the level control unit 102. This low-pass filter 100 cuts a preselected high frequency component and then supplies this filtered signal to the level control unit 101. Both the level control unit 101 and the level control unit 102 control the level of the input signal based on the sound image localization direction data derived from the CPU (not shown). The signals outputted from the level control unit 101 and the level control unit 102 are supplied to the adder 103. Then, these supplied signals are added by this adder 103 to produce an added signal. This added signal is supplied as the correction signal to the above-described time difference signal producing means 11.

Figure 12:
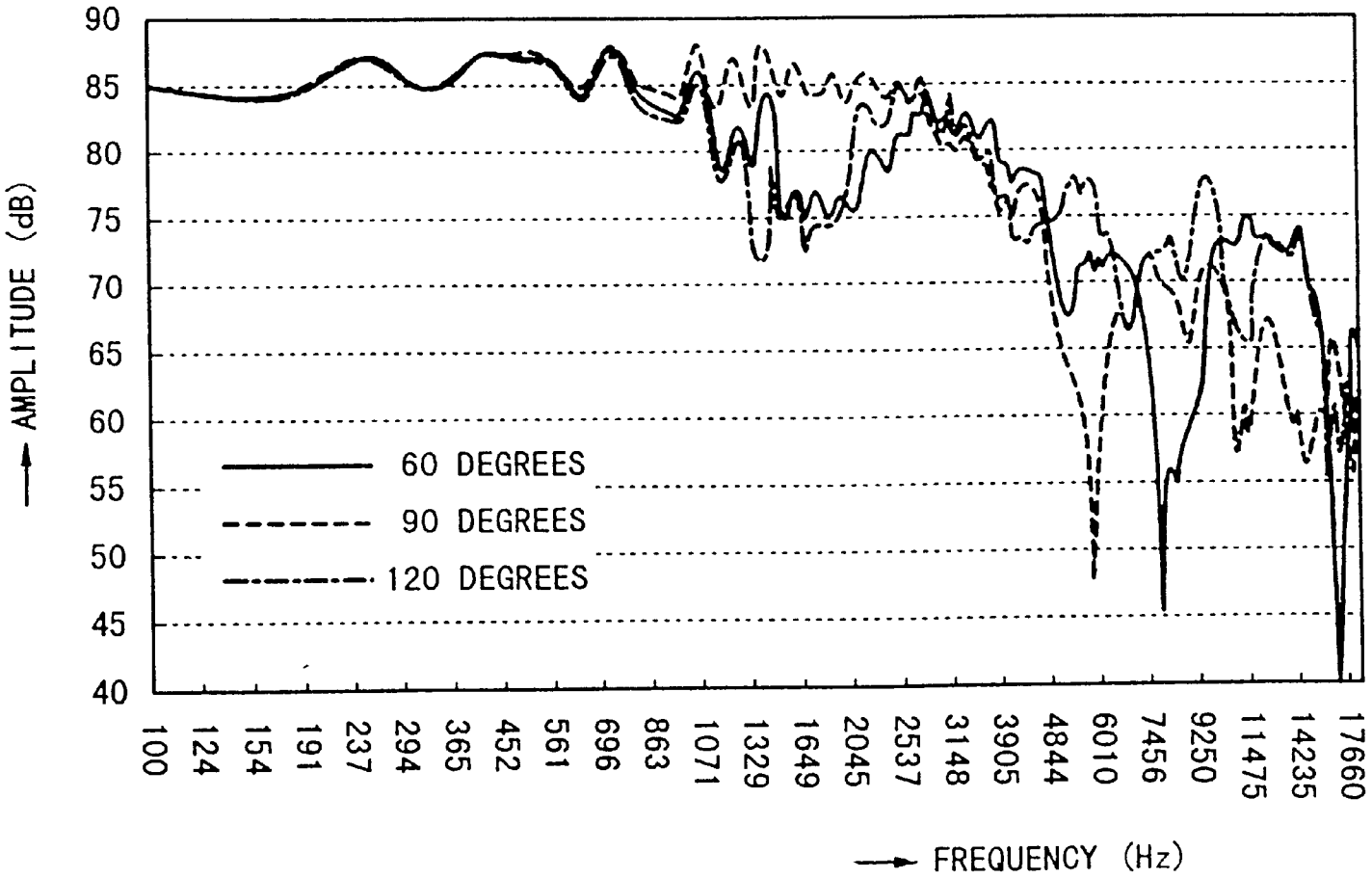
FIG. 12 is an explanatory diagram for explaining a step for determining a characteristic of a low-pass filter employed in the correcting means shown in FIG. 11.

The filter characteristic of the above-mentioned low-pass filter 100 may be determined as follows: Assuming now that the sound quality is not corrected, such a sound having a characteristic processed by the relative function is entered into the left ear of the audience, and another sound having a characteristic directly reflected by an input signal which has not been processed is entered into the right ear of this audience. How to correct this characteristic is determined based upon a transfer characteristic of the right ear. FIG. 12 graphically indicates an example of the right ear's transfer function. A common fact in the respective sound image localization directions in the transfer characteristic of FIG. 12 is given as follows: That is, an attenuation is commenced from the frequency of approximately 1 kHz. As a consequence, as a filter capable of correcting the sound quality, a first order low-pass filter 100 having a cut-off frequency of 1 kHz is suitably used.

A function $G(s)_{LPF1}$ for defining the filter characteristic of this first order low-pass filter 100 can be expressed by the following formula (7):

$$G(s)_{LPF1} = \frac{\omega_{LPF1}}{s + \omega_{LPF1}} \qquad \text{formula (7)}$$

$$f_{LPF1} = \frac{\omega_{LPF1}}{2\pi} = 1 \text{ kHz}$$

where symbol "s" is Laplacean, symbol "$\omega_{LPF1}$" denotes an angular frequency, and symbol "$f_{LPF1}$" shows a cut-off frequency.

Figure 13:
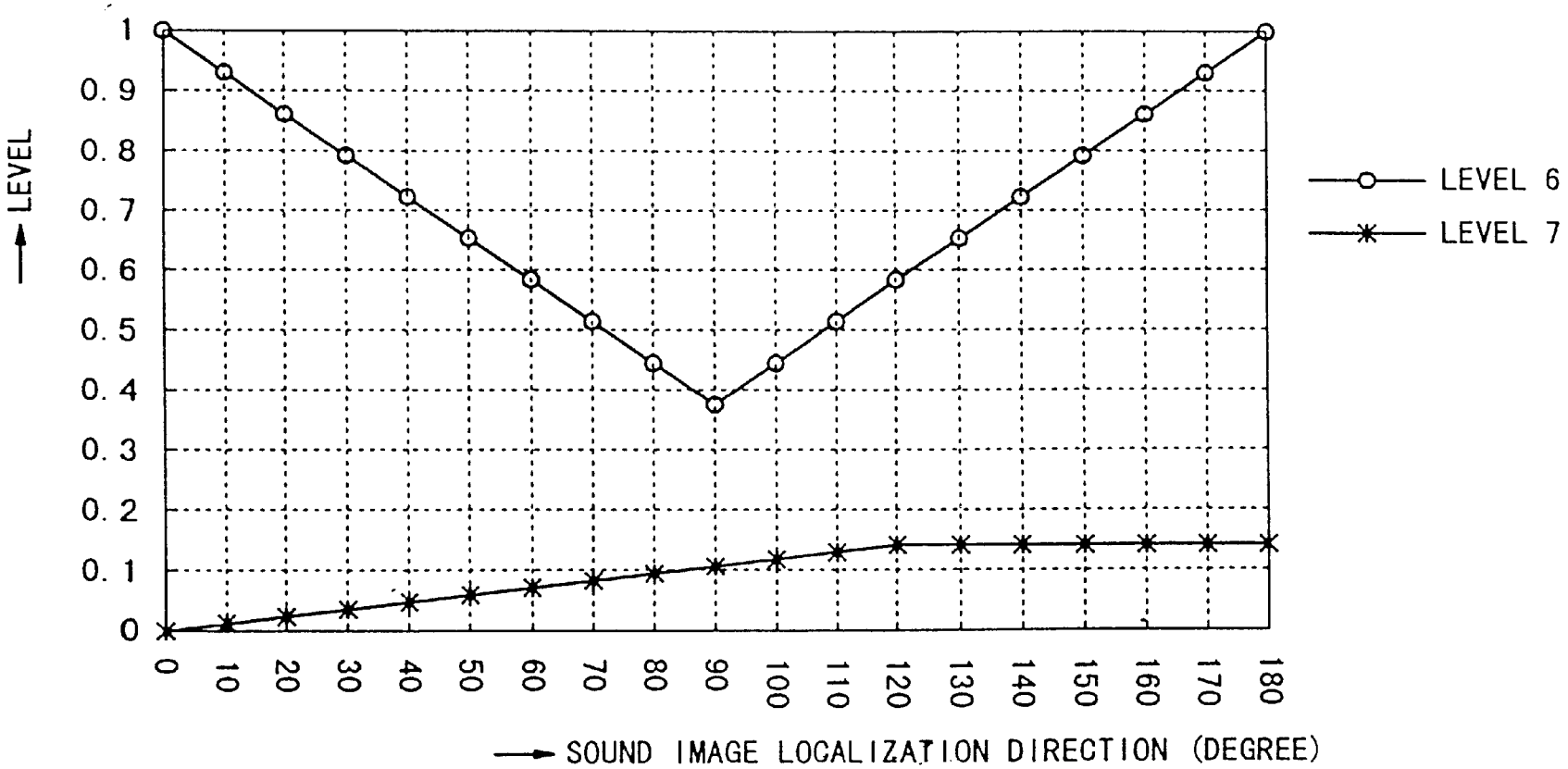
FIG. 13 is a relationship between a level and a sound image localization direction, controlled by a level control unit of the correcting means shown in FIG. 11.

Also, the level control units 101 and 102 of the correcting means 10 determine the levels in the respective level control units 101 and 102 in accordance with the sound image localization direction data supplied from the CPU (not shown). When the sound image localization direction is subdivided into a plurality of ranges (angles), relationships between the sound image localization directions and the levels may be approximated by employing a linear function with respect to each of these ranges. In the following description, the level in the level control unit 102 will be referred to as a "level 6", and the level in the level control unit 101 will be referred to as a "level 7". A relationship between the sound image localization direction and the level is indicated in FIG. 13. It should be noted that although the sound image localization direction shown in FIG. 13 indicates the range limited from 0 degree to 180 degrees, another sound image localization direction defined from 180 degrees to 360 degrees may be approximated by employing the linear function.

As previously described in detail, in accordance with the sound image localization apparatus of the embodiment mode 1, the sound images can be localized at an arbitrary position in the three-dimensional space by employing a simple and low-cost circuit, or a simple process operation. Moreover, this sound image localization apparatus can own the superior real time characteristic.

Figure 14:
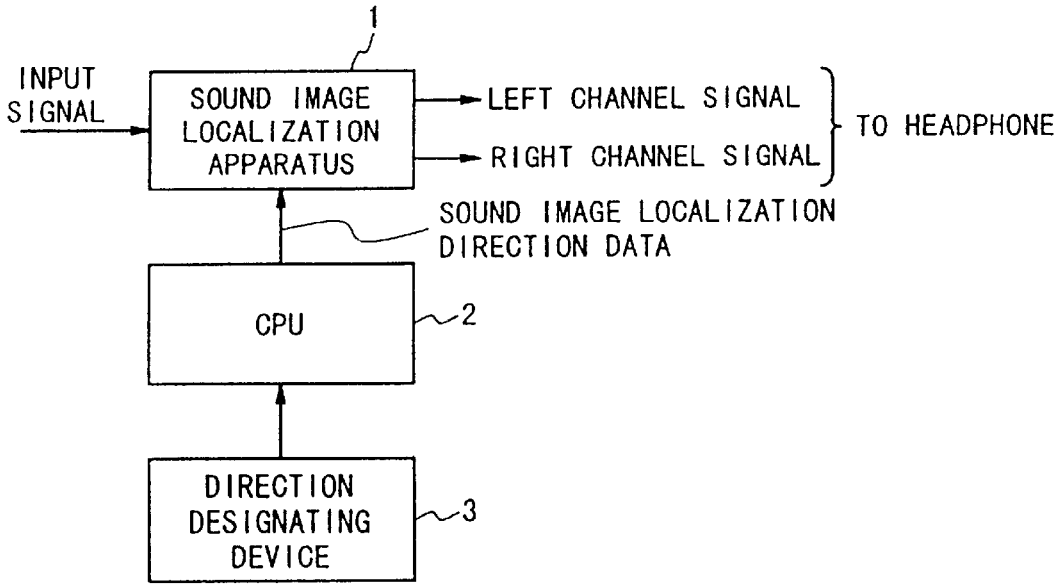
FIG. 14 represents a first application example of the sound image localization apparatus according to the present invention.

Next, a description will now be made of a sound image control apparatus to which the above-explained sound image localization apparatus 1 has been applied. FIG. 14 is a schematic block diagram for indicating an arrangement of a sound image control apparatus when an audience hears sounds by using a headphone. In this sound image localization 1, a monaural input signal is supplied from a tone generator (not shown). Also, sound image localization direction data is supplied from a CPU 2 to this sound image localization apparatus 1. As previously described, the sound image localization apparatus 1 processes the input signal based on this sound image localization direction data to thereby produce a left channel signal and a right channel signal. These left channel signal and right channel signal are furnished to the headphone.

A direction designating device 3 is connected to the CPU 2. As this direction designating device 3, for example, a joystick, and other various devices capable of designating the direction may be employed. A signal indicative of the direction designated by this direction designating device 3 is supplied to the CPU 2.

In response to the signal indicative of the direction designated by the direction designating device 3, the CPU 2 produces sound image localization direction data. Concretely speaking, the CPU 2 produces data used to designate the gains of the respective level control units (amplifiers) 101, 102, 134 to 138, and also produces data used to produce the inter aural time difference data. Then, the CPU 2 supplies both the data to the sound image localization apparatus 1. As a consequence, as previously explained, the sound image localization apparatus 1 performs the above-described process operation to thereby output a left channel signal and a right channel signal. When these left/right channel signals are heard by the audience by using the headphone, it seems as if the audience could hear that the sound source is localized along the direction designated by the direction designating device 3.

Alternatively, the above-explained direction designating device 3 may be replaced by, for instance, a signal indicative of a position of a character in an electronic video game. When this alternative arrangement is employed, a sound image position is moved in a direction along which the character is also moved, and when this character is stopped, the sound image is localized at this position. In accordance with this arrangement, the audience can enjoy stereophonic sounds, which are varied in response to movement of the character.

Figure 15:
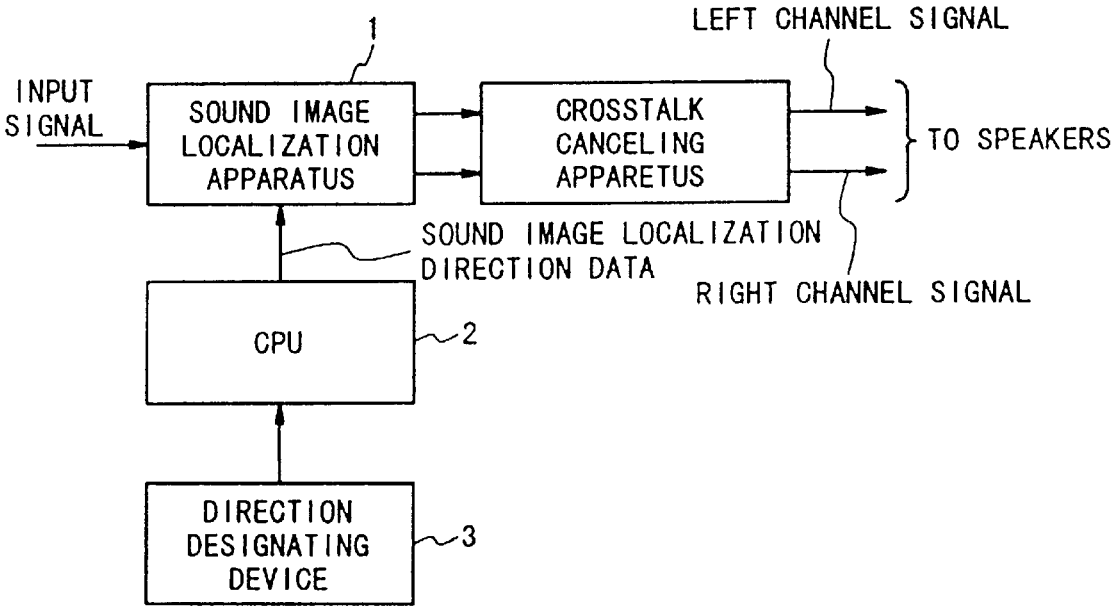
FIG. 15 represents a second application example of the sound image localization apparatus according to the present invention.

FIG. 15 is a schematic block diagram for indicating an arrangement of a sound image control apparatus to which the above-explained sound image localization apparatus has been applied when an audience hears sounds by using speakers. It should be understood that this sound image control apparatus is arranged by way that a crosstalk canceling apparatus 4 is further added to the sound image control apparatus shown in FIG. 14.

The crosstalk canceling apparatus 4 is such an apparatus capable of producing a sound field like headphone sound listening by canceling the crosstalk sound. As this crosstalk canceling apparatus 4, for instance, a Schroeder type crosstalk canceling apparatus may be employed. With employment of this arrangement, a similar effect can be obtained even when the audience hears the sounds by using the speakers, similar to that when the audience hears the sounds by using the headphone.

EMBODIMENT MODE 2

In the above-described sound image localization apparatus of the embodiment mode 1, when the sound image is moved, the delay amount corresponding to the inter aural time difference must be varied in real time. In this case, when the delay amount corresponding to the present localization position of the sound image is suddenly changed into another delay amount corresponding to a new localization position of this sound image, the signal is discontinued, resulting in noise. To avoid this noise problem, one technical solution is conceivable. That is, the delay amount is cross-faded by employing a cross-fade system similar to the sound localization apparatus described in the above-explained Japanese Laid-open Patent Application (JP-A-Heisei 04-30700) in order to eliminate the noise.

However, when this cross-fade system is introduced, for instance, the delay amount should be cross-faded while transferring the cross-fade coefficient from the externally provided CPU to the DSP. As a result, the time period used to transfer the cross-fade coefficient from the CPU to the DSP would be largely prolonged. Concretely speaking, the time period used to transfer a single cross-fade coefficient from the CPU to the DSP is defined by the data reception allowable speed of this DSP, at least approximately 500 $\mu$ seconds are required. As an example, in such a case that the sound image localization direction data are stored every 10 degrees and a cross-fade coefficient corresponding each of these sound image localization direction data is subdivided into 100 level data so as to move the sound image, a time period required to circulate the sound image becomes $36\times100\times500$ $\mu$ sec=1.8 sec. However, in the actual sound image control apparatus, since data other than the cross-fade coefficients are transferred, a further longer time period is necessarily needed so as to transfer these data. This implies that the sound image could not be moved in high speeds. Also, when the sound image is smoothly moved, the sound image localization direction data are required every a smaller angle than 10 degrees, and a cross-fade coefficient corresponding to each of these sound image localization direction data is subdivided into arbitrary-numbered level data larger than 100. However, such a smoothing movement of the sound image is performed, the moving speed of the sound image is lowered, resulting in a practical problem. Moreover, since the CPU must produce the cross-fade coefficients in response to the change in the delay amount, the complex control sequence operation is required, and also the heavy load is needed in this CPU.

Figure 16:
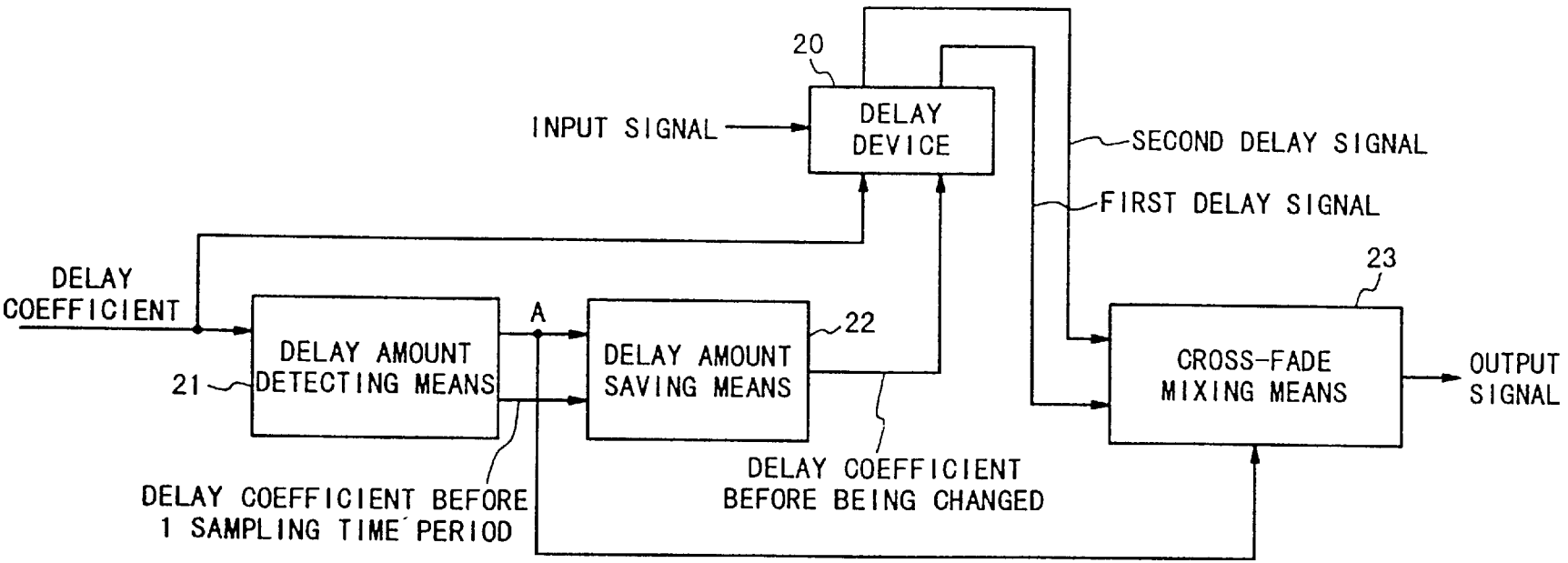
FIG. 16 is a schematic block diagram for indicating an arrangement of a delay amount control apparatus according to an embodiment of the present invention.

As will be described in detail, a delay amount control apparatus according to a second embodiment mode 2 of the present invention can solve the above-described problem. FIG. 16 is a schematic block diagram for representing a delay amount control apparatus according to an embodiment 2 of the present invention. This delay amount control apparatus may be arranged by a memory built in a DSP and a software processing operation by this DSP. This DSP is operated while a sampling time period "T" is set to, for instance, T =1/48,000 seconds as a 1 processing cycle. It should be noted that the above-described memory may be realized by such a memory externally connected to this DSP.

This delay amount control apparatus executes a delay process operation for an externally supplied input signal. The input signal is constituted by a sampling data string to thereby output the processed signal. This sampling data string is externally supplied to a delay device 20 every sampling time period.

Figure 17:
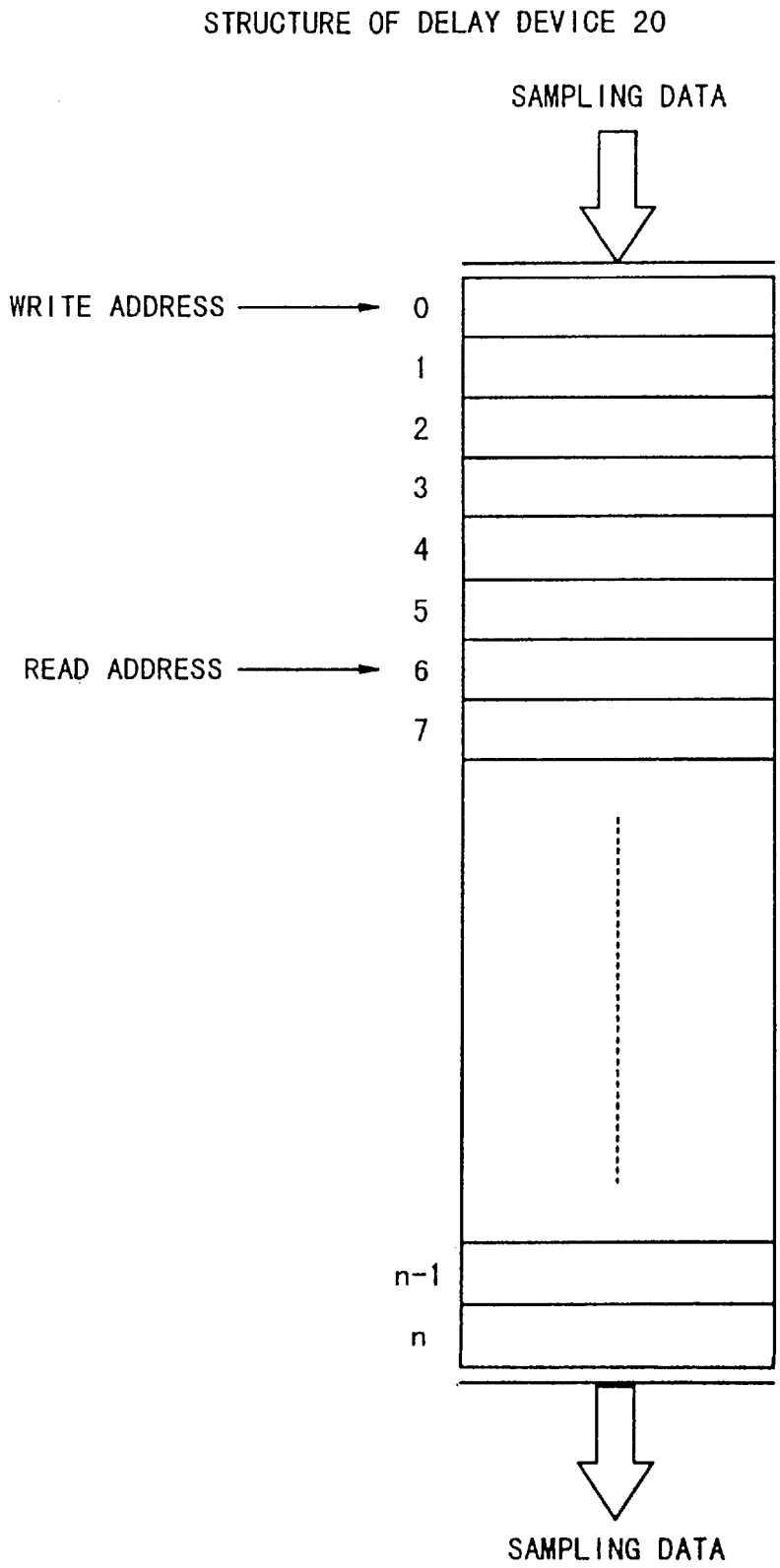
FIG. 17 is a schematic diagram for showing an arrangement of a delay device employed in the delay amount control apparatus shown in FIG. 16.

It should be noted that this delay device 20 corresponds to delay means of the present invention, and is arranged by the memory built in the DSP, or the memory connected to this DSP. This memory owns, for instance, (n+1) pieces of storage regions (see FIG. 17), and sampling data is stored into each of these storage regions. A storage capacity of this memory is determined by a maximum delay amount handled by this delay amount control apparatus. The externally supplied sampling data is written into a storage region of this memory designated by a write address. A delay coefficient (factor) of the present invention is constituted by a read address. The sampling data read out from the region designated by this read address is supplied as a first delay signal and a second delay signal to a cross-fade mixing means 23 (see FIG. 16).

Referring now to the above-explained circuit arrangement, operations of the delay device 20 will be described. It should also be noted that the write address is always constant (address "0"). When one piece of sampling data is supplied to this delay device 20, the respective sampling data which have previously been stored in this memory are shifted only by one sampling data along an upperstream direction of the address prior to writing of this externally supplied sampling data into the memory. As a result, since the storage region defined at the address "0" becomes empty, this externally supplied sampling data is written into this empty storage region at the address "0". As a consequence, the latest sampling data is stored into the storage region at the address "0" in this memory, whereas the old sampling data are successively stored in the storage regions defined while the addresses thereof are successively increased.

Next, sampling data is read out from a storage region of the memory designated by a read address as a delay coefficient. A relationship between the delay amount and the read address is given as follows. In other words, when an input signal is delayed only by an "i" sampling time period and then the delayed input signal is outputted, "i" is designated as the read address. Since a content of a storage region designated by this address "i" is data written before the "i" sampling time period, reading of the storage content designated at the address "i" in this process cycle implies that the sampling data delayed only by the "i" sampling time period is read out from the memory. Subsequently, since the storage contents of the memory are refreshed every process cycle, if the storage content designated by the address "i" is read every process cycle, then the sampling data delayed only by the "i" sampling time period can be continuously and sequentially read. In other words, the delay device 20 outputs signals delayed by the delay amounts in accordance with the delay coefficient.

Figure 18:
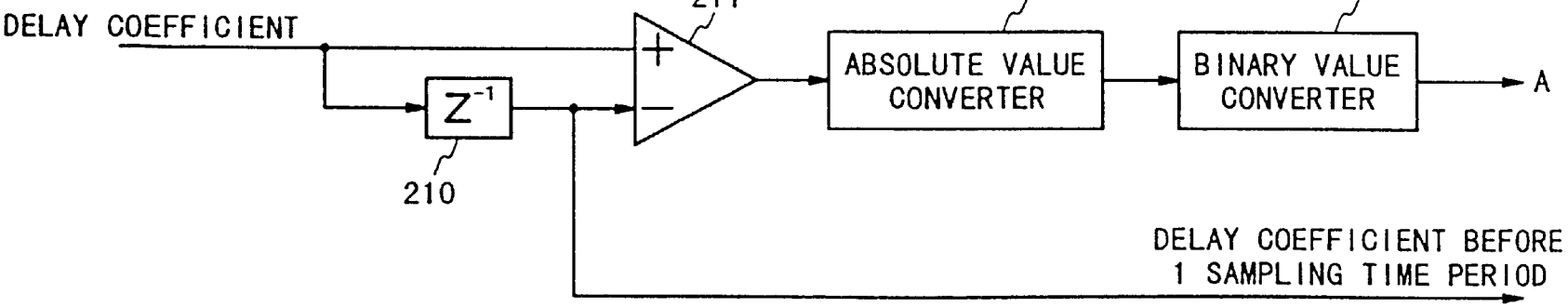
FIG. 18 is a schematic diagram for showing an arrangement of a delay amount detecting means employed in the delay amount control apparatus indicated in FIG. 16.

Referring now to FIG. 18, a concrete arrangement of a delay amount detecting means 21 will be described. This delay amount detecting means 21 investigates as to whether or not the externally supplied delay coefficient is changed from the delay coefficient before the 1 sampling time period, and outputs the investigation result as a delay amount change detection signal "A". This delay amount change detection signal "A" becomes "0" when the externally supplied delay coefficient is not changed, and becomes "1" when this externally supplied delay coefficient is changed.

In FIG. 18, a unit delay device 210 delays the externally supplied delay coefficient only by a 1 sampling time period. The delay coefficient before 1 sampling time period derived from this unit delay device 210 is supplied to an input terminal (−) of a subtracter 211, and a delay amount saving means 22 (see FIG. 16) which will be explained later.

The subtracter 211 subtracts the delay coefficient before 1 sampling time period from the externally supplied delay coefficient. A subtraction output of this subtracter 211 is supplied to an absolute value converter 212. The absolute value converter 212 converts the subtraction data derived from the subtracter 211 into an absolute value. The absolute value obtained from the absolute value converter 212 is supplied to a binary value converter 213. This binary value converter 213 converts the absolute value data derived from the absolute value converter 212 into a binary value of "0", or "1". This binary value converter 213 may be realized by such that, for instance, the absolute value derived from the absolute value converter 212 is multiplied by a large value, and then this multiplied result is clipped by a predetermined value.

Figures 21A, 21B, 21C, 21D, 21E:
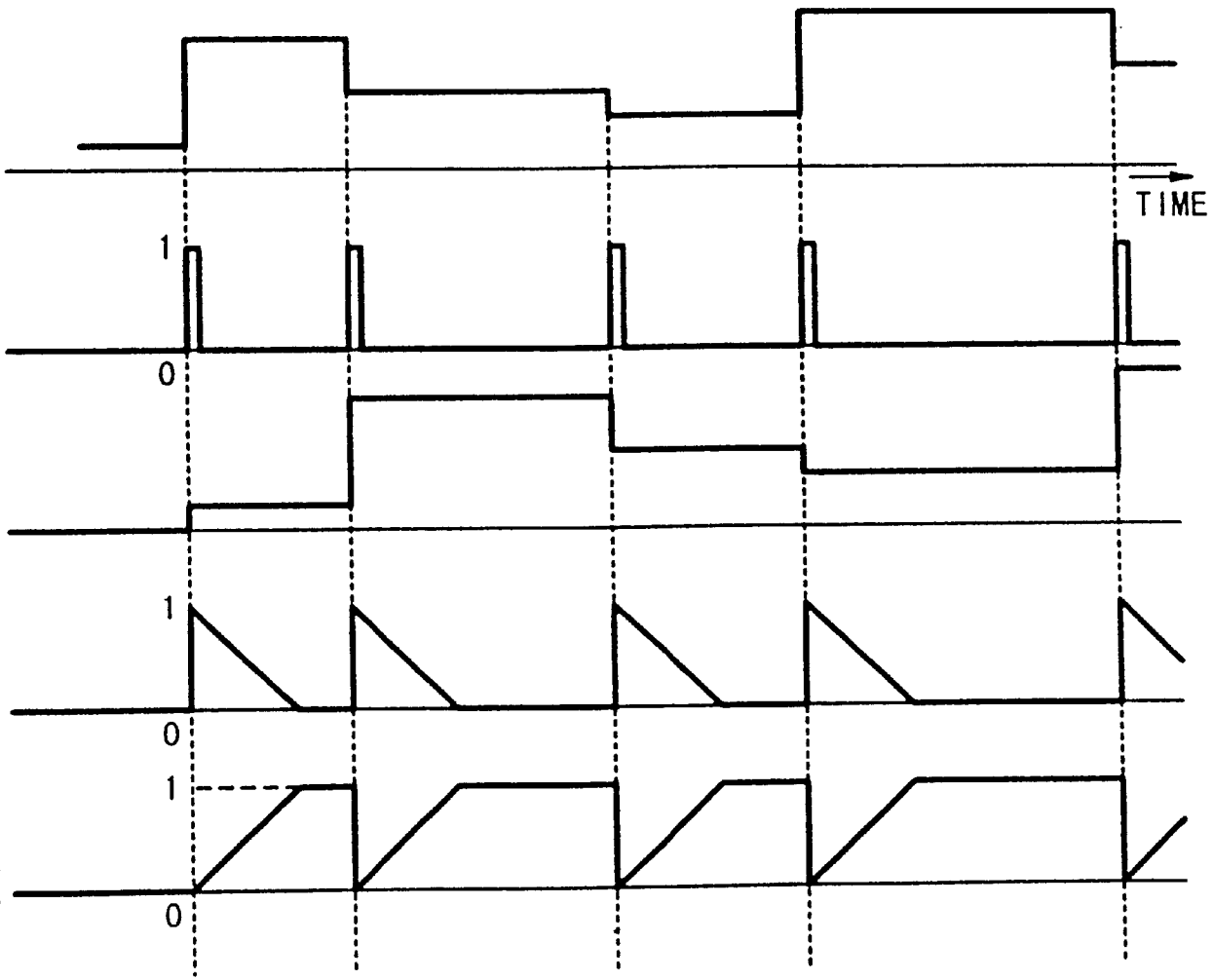
FIGS. 21A through 21E, is a timing chart for describing operations of the delay amount control apparatus indicated in FIG. 16.

As a result, when the externally supplied delay coefficient is changed from the delay coefficient before 1 sampling time period, the delay amount change detection signal "A" derived from this delay amount detecting means 21 becomes "1" only during the 1 sampling time period, and becomes "0" in other cases. The above-described conditions are represented in FIG. 21A and FIG. 21B. FIG. 21A indicates the externally supplied delay coefficient, and such a condition that the value of this delay coefficient is varied at an arbitrary timing. FIG. 21B shows the delay amount change detection signal "A", and becomes "1" only during the 1 sampling time period every time the externally supplied delay coefficient is changed, i.e., falls and rises of the signals corresponding to the externally supplied delay coefficient signals. The delay amount change detection signal "A" derived from this delay amount detecting means 21 is supplied to the delay amount saving means 22 and the cross-fade mixing means 23 (see FIG. 16) (will be described later).

Figure 19:
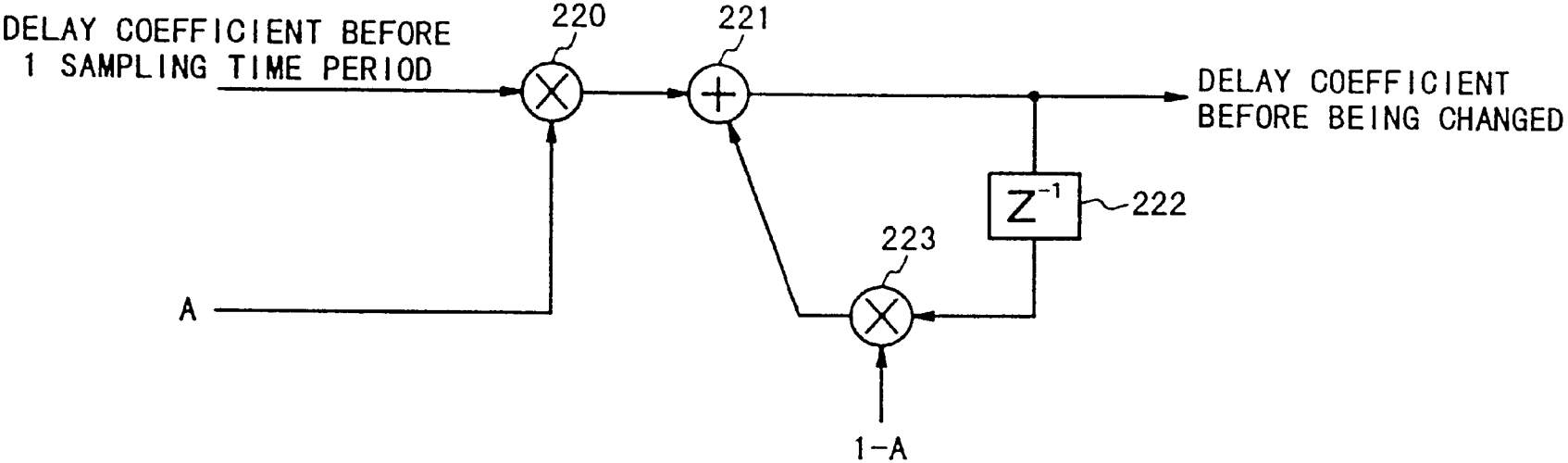
FIG. 19 is a schematic diagram for showing an arrangement of a delay amount saving means employed in the delay amount control apparatus shown in FIG. 16.

Now, the delay amount saving means 22 will be described. In the case that the externally supplied delay coefficient is changed, this delay amount saving means 22 saves such a delay coefficient before this delay coefficient change. As indicated in FIG. 19, this delay amount saving means 22 is constructed of a multiplier 220, an adder 221, a unit delay device 222, and another multiplier 223.

The multiplier 220 multiplies the delay coefficient before 1 sampling time period sent from the delay amount detecting means 21 by the delay amount change detection signal "A" similarly sent from this delay amount detecting means 21. As a consequence, this multiplier 220 outputs "0" when the delay amount change detection signal "A" becomes "0", namely the externally supplied delay coefficient is not changed, whereas this multiplier 220 outputs the delay coefficient before 1 sampling time period when the delay amount change detection signal "A" becomes "1", namely the externally supplied delay coefficient is changed. A multiplied output of this multiplier 220 is furnished to the adder 221.

The adder 221 adds the multiplied data from the multiplier 220 to the multiplied data from the multiplier 223. This added result is supplied as a delay coefficient before being changed to the delay device 20 (see FIG. 16) and the unit delay device 222. The unit delay device 222 delays the output of the adder 221, namely the delay, coefficient before being delayed only by 1 sampling time period. The output derived from this unit delay device 222 is supplied to the multiplier 223. The multiplier 223 multiplies the data derived from the unit delay device 222 by a signal "1-A". This signal "1-A" is produced by subtracting the delay amount change detection signal "A" from a value "1" by using a subtracter (not shown in detail). The output of this multiplier 223 is supplied to the adder 221.

With the above-described arrangement, operation of the delay amount saving means 22 will now be described. Under an initial condition, the delay amount change detection signal "A" is initially set to "0", and the output of the unit delay device 222 is initially set to zero by a control unit (not shown). As a result, under this initial state, the delay coefficient before being changed becomes zero. When the delay amount change detection signal "A" is changed into "1" by externally supplying the delay coefficient under this initial state, the delay coefficient before 1 sampling time period is supplied through the multiplier 220 to the adder 221. On the other hand, since zero is outputted from the multiplier 223, the delay coefficient before 1 sampling time period is outputted through this adder 221 as a delay coefficient before being changed to the external devices.

The delay amount change detection signal "A" is changed into "0" in the next sampling time period. As a result, the output of the unit delay device 222 is equal to the delay coefficient before being changed. This delay coefficient before being changed is supplied to the multiplier 223. This multiplier 223 causes the delay coefficient before being changed to pass through this multiplier 223 and supplies this delay coefficient before being changed to the adder 221. On the other hand, since zero is supplied from the multiplier 220 to the adder 221, the adder 221 directly outputs the delay coefficient before being changed which is derived from the unit delay device 222. As a result, as long as the delay amount change detection signal "A" is equal to "0", namely as long as the externally supplied delay coefficient is not changed, the above-described delay coefficient before being changed is saved in this delay amount saving means 22. Under this condition, when another delay coefficient is newly supplied from the external device so that the delay amount change detection signal "A" is changed into "1", this delay amount saving means 22 saves the delay coefficient which has been externally supplied as the delay coefficient before being changed, and also outputs this delay coefficient before being changed to the external device in a similar manner as described above.

The above-described condition is represented in FIG. 21C. That is, FIG. 21C represents such a condition that every time the delay amount change detection signal "A" becomes "1", the delay coefficient which has been so far supplied from the external device is outputted as the delay coefficient before being changed.

Next, the cross-fade mixing means 23 will now be described. This cross-fade mixing means 23 delays the input signal in response to the changed delay amount to output the delayed input signal. The delay amount is changed in a range from a-delay amount designated by the delay coefficient before being changed up to a new delay amount designated by the externally supplied delay coefficient. This cross-fade mixing means 23 is arranged by the cross-fade coefficient producing unit shown in FIG. 20A and the mixing unit shown in FIG. 20B.

Figure 20A:
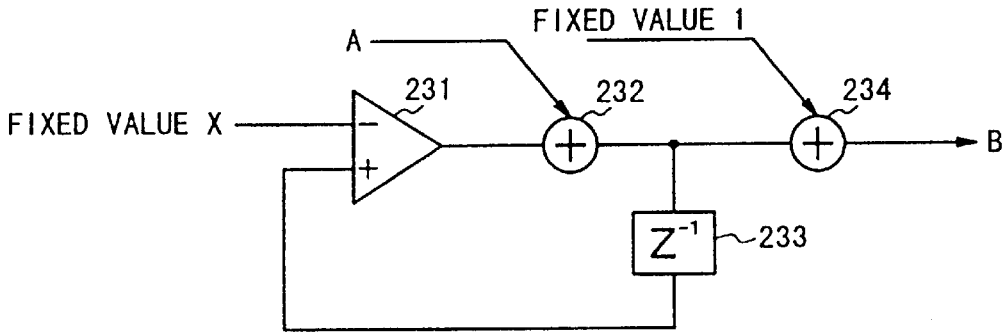
FIG. 20A is a diagram for representing an arrangement of a cross-fade coefficient producing unit in a ross-fade mixing means employed in the delay amount control apparatus shown in FIG. 16.

As represented in FIG. 21D, the cross-fade coefficient producing unit produces a first cross-fade coefficient B which is decreased in connection with a lapse of time. As shown in FIG. 20A, this cross-fade coefficient producing unit is arranged by a subtracter 231, an adder 232, a unit delay device 233, and another adder 234.

The subtracter 231 subtracts a fixed value "X" from the data derived from the unit delay device 233. The fixed value "X" is properly selected from a value of a range defined $0<X<1$. This fixed value X determines an attenuation rate (namely, inclination of waveform shown in FIG. 21D). Also, the subtracter 231 corresponds to a subtracter equipped with a limitation function. In the case that the subtraction result becomes smaller than "−1", this subtracter 231 outputs "−1". This subtraction result is supplied to the adder 232.

The adder 232 adds the subtraction data from the subtracter 231 to the delay amount change detection signal "A". The addition result is supplied to the unit delay device 233 and the adder 234. The unit delay device 233 delays the output signal derived from the adder 232 only by 1 sampling time period, and then supplies the delayed output signal to the subtracter 231. The adder 234 adds the output signal derived from the adder 232 to the fixed value "1". This addition result is employed as a first cross-fade coefficient B.

Subsequently, operation of this cross-fade coefficient producing unit will now be explained. Under initial condition, the unit delay device 233 outputs zero and the delay amount change detection signal "A" is set to "0" under control by a control unit (not shown). Under this initial condition, the subtracter 231 subtracts the fixed value X from zero. This subtraction result passes through the adder 232, and then is supplied to the unit delay device 233 and the adder 234. These operations are repeatedly performed every sampling time period. As a result, the adder 232 outputs such a data which is linearly decreased from zero to "−1", and continues to output the data of "−1" when this decreased data reaches "−1".

When the delay amount change detection signal "A" is changed into "1" under such a state that the subtracter 231 outputs "−1", the adder 232 outputs zero. As a result, the cross-fade coefficient generating unit is brought into the same condition as the above-described initial condition. As a consequence, the adder 232 again outputs such a data which is linearly decreased from zero to "−1", and continues to output the data of "−1" when this data reaches "−1". Subsequently, the above-defined operation is repeatedly executed every time the delay amount change detection signal "A" becomes "1", namely every time the new delay coefficient is externally supplied.

In the adder 234, "1" is added to the addition result (namely, such a data changed from "0" to "−1") derived from the adder 232. Accordingly, as illustrated in FIG. 21D, the data which is linearly decreased from "1" to zero is obtained, and the data of zero is continuously outputted when this data reaches zero from this adder 234. The output from this adder 234 is employed as the first cross-fade coefficient B. It should also be noted that a second cross-fade coefficient 1-B indicated in FIG. 21E is obtained by subtracting the first cross-fade coefficient B from the value "1" in a subtracter (not shown).

Figure 20B:
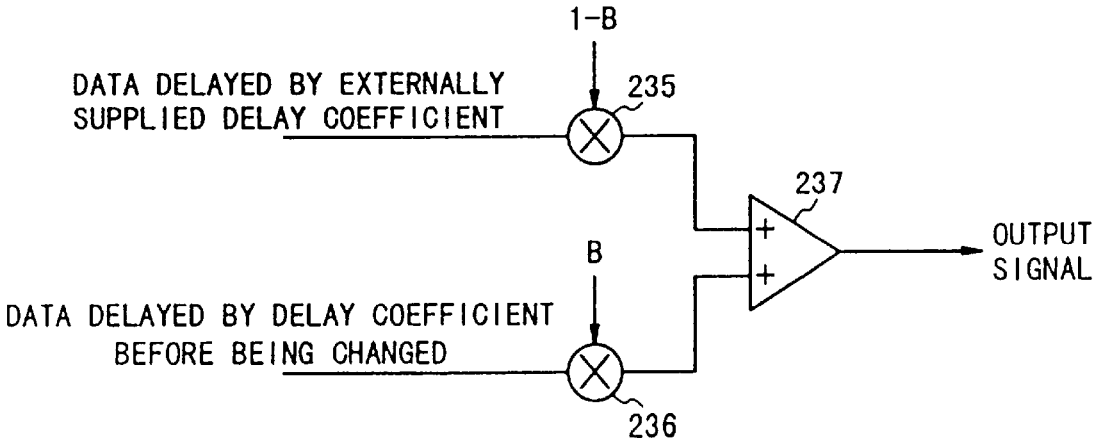
FIG. 20B is a diagram for representing an arrangement of a mixing unit in the cross-fade mixing means employed in the delay amount control apparatus shown in FIG. 16.

The mixing unit shown in FIG. 20B is constituted by a multiplier 235, another multiplier 236, and an adder 237. The multiplier 235 multiplies sampling data by the second cross-fade coefficient 1-B. This sampling data is read from a region of the delay device 20 (memory) designated by the externally supplied delay coefficient. Also, multiplier 236 multiplies another sampling data by the first cross-fade coefficient B. This sampling data is read from a region of the delay device 20 (memory) designated by the delay coefficient before being changed. The adder 237 adds the data derived from the multiplier 235 to the data derived from the multiplier 236. This addition result is outputted to the external device as an output signal derived from this delay amount control apparatus. As a result, the output signal is gradually changed from the signal having the delay amount designated by the delay coefficient before being changed into the signal having the delay amount designated by the newly and externally supplied delay coefficient. Then, finally, the output signal becomes such an input signal delayed by the delay amount, which is designated by the newly and externally supplied delay coefficient.

As previously described, in accordance with this delay amount control apparatus, even when no instruction is issued from the externally provided CPU, two sets of signals produced by delaying the input signal based on the different delay amounts from each other are cross-faded within the DSP. As a consequence, even when the delay amounts are varied in the discrete manner, no noise is produced, and the delay amount can be changed with a small amount of processing operations.

It should be understood that when the externally supplied delay coefficient is changed before the cross-fade coefficient B becomes zero, there is a certain possibility that noise is produced. However, this possible problem may be solved by properly selecting the fixed value "X", taking account of the minimum value of the data transfer time to the DSP.

While the delay amount control apparatus of the present invention has been described in detail, the delay amount can be changed in high speed without producing the noise. Since the delay amount data are cross-faded inside this delay amount control apparatus (DSP), the CPU merely transfers the data used to designate one delay amount to this delay amount control apparatus, and therefore need not sequentially send a plurality of cross-fade coefficients in response to the delay amounts. As a result, the control sequence executed in the CPU can be made simple, and further the workload thereof can be reduced.

Figure 22:
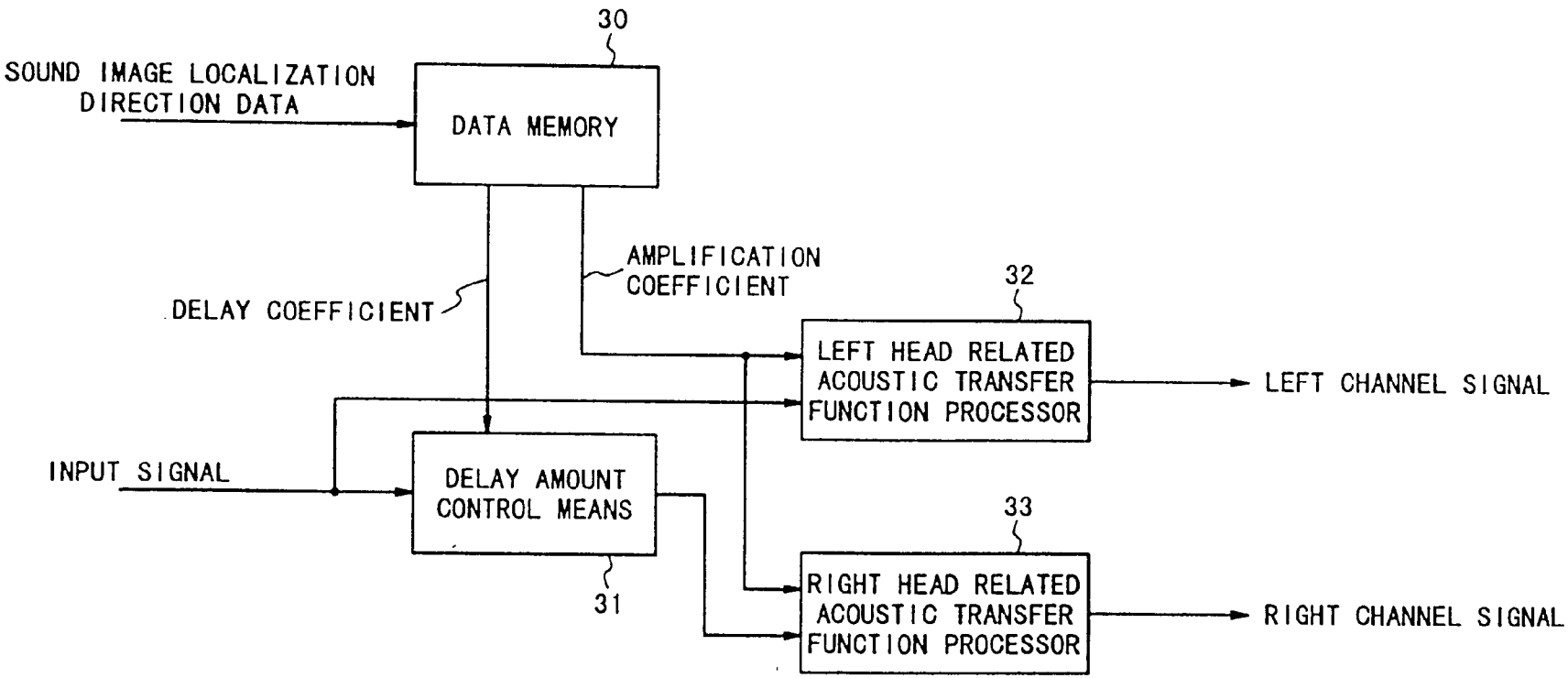
FIG. 22 is a schematic block diagram for indicating an arrangement of a sound image control apparatus according to an embodiment of the present invention.

Next, a description will now be made of a sound image control apparatus utilizing the above-explained delay amount control apparatus, according to an embodiment of the present invention. FIG. 22 is a schematic block diagram for showing the embodiment of this sound control apparatus. This sound control apparatus is realized by executing a software process operation by the DSP.

In FIG. 22, a data memory 30 stores therein a delay coefficient and an amplification coefficient as one set with respect to each of directions of sound sources viewed from an audience, namely each of directions (angles) along which sound images are localized. For instance, in the sound image localization apparatus for controlling the sound image localization direction every 10 degrees, 36 sets of delay coefficients/amplification coefficients are stored. Any one of these 36 coefficient set is read out from the memory, depending upon the externally supplied sound image localization direction data. Then, the read delay coefficient is supplied to the delay amount control means 31, and the amplification coefficient is supplied to a left head related acoustic transfer function processor 32 and a right head related acoustic transfer function processor 33, respectively.

As the delay amount control means 31, the above-described delay amount control apparatus is employed. For example, both an externally entered monaural input signal and a delay coefficient read out from the data memory 30 are inputted. This delay coefficient owns a value capable of reflecting a direction of a sound source as viewed from an audience, namely a value corresponding to a sound image localization direction (angle).

In the case that the sound image is localized, the input signal is delayed only by the inter aural time difference corresponding to the delay coefficient, and then the delayed input signal is outputted from the delay amount control means 31. On the other hand, when the sound image is moved, a signal outputted from the delay amount control means 31 is gradually changed from a signal having a delay amount designated by the delay coefficient before being changed into another signal having a delay amount designated by the externally supplied delay coefficient. The signal outputted from this delay amount control means 31 is supplied to the right head related acoustic transfer function processor 33.

The left head related acoustic transfer function processor 32 simulates a head related acoustic transfer function of a sound entered into the left ear of the audience. Into this left head related acoustic transfer function processor 32, both an input signal and an amplification coefficient for the left channel are entered. This amplification coefficient for the left channel is used to simulate a left head related acoustic transfer function. A signal derived from this left head related acoustic transfer function processor 32 is externally outputted as a left channel signal.

The right head related acoustic transfer function processor 33 simulates a head related acoustic transfer function of a sound entered into the right ear of the audience. Into this right head related acoustic transfer function processor 33, both the signal from the delay amount control means 31 and an amplification coefficient for the right channel are entered. This amplification coefficient for the right channel is used to simulate a right head related acoustic transfer function. A signal derived from this right head related acoustic transfer function processor 33 is externally outputted as a right channel signal.

Figure 23:
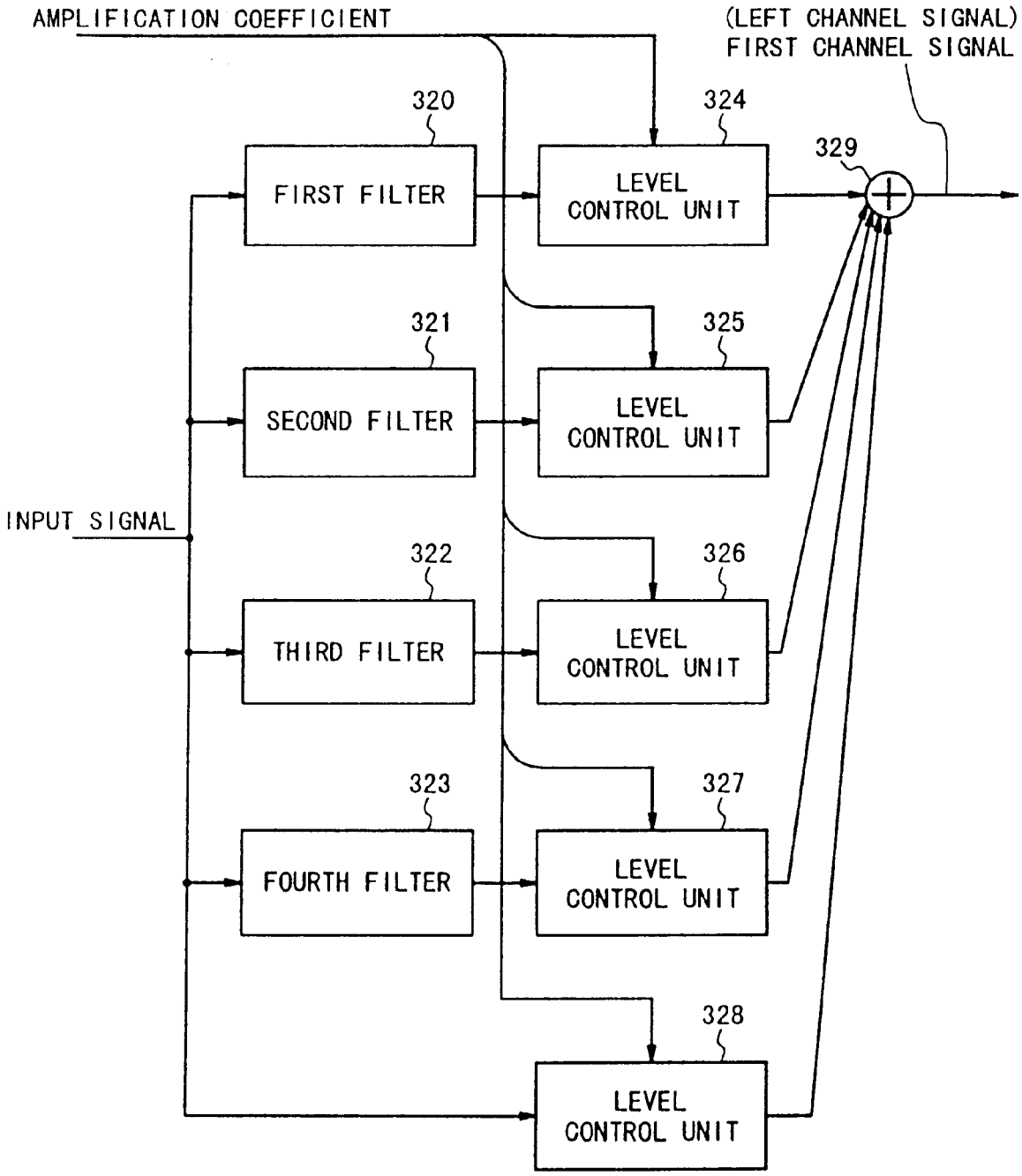
FIG. 23 is a schematic block diagram for showing an arrangement of a left head related acoustic transfer function processor employed in the sound image control apparatus shown in FIG. 22.

It should be understood that since the left head related acoustic transfer function processor 31 and the right head related acoustic transfer function processor 33 each own the same arrangements, the arrangement of only the left head related acoustic transfer function processor 32 will now be described. For example, as represented in FIG. 23, the left head related acoustic transfer function processor 32 is arranged by filters 320 to 323, level control units 324 to 328, and an adder 329. Since the arrangement of this left head related acoustic transfer function processor 32 is substantially same as that of the function processing means 13 employed in the embodiment 1 shown in FIG. 5, a brief explanation thereof is made as follows:

In FIG. 23, the first filter 320 is constructed of a band-pass filter having a central frequency of approximately 1.5 kHz. The second filter 321 is arranged by a band-pass filter having a central frequency of approximately 5 kHz, and the third filter 322 is constituted by a band-pass filter having a central frequency of approximately 8 kHz. The fourth filter 323 is arranged by a high-pass filter having a cut-off frequency of approximately 10 kHz. The respective filters are constituted of second order IIR type filters. These first to fourth filters 320 to 323 are arranged by fixed filters. As a consequence, since the filter coefficients are not required to be replaced, there is no noise caused when the filter coefficients are replaces. An externally entered input signal is supplied to those first to fourth filters 320 to 323. It should also be noted that in the case of the right head related acoustic transfer function processor 33, the signal derived from the delay amount control means 31 is inputted.

The level control unit 324 controls a level of a signal filtered from the first filter 320 based on the corresponding amplification coefficient, and the level control unit 325 controls a level of a signal filtered from the second filter 321 based upon the corresponding amplification coefficient. The level control unit 326 controls a level of a signal filtered from the third filter 322 based on the corresponding amplification coefficient, and the level control unit 327 controls a level of a signal filtered from the fourth filter 323 based upon the corresponding amplification coefficient. Also, the level control unit 328 controls a level of the input signal based on the corresponding amplification coefficient. The respective level control units 324 to 328 correspond to a plurality of amplifiers according to the present invention, and are arranged by, for instance, multipliers.

The adder 329 adds the respective level-controlled signals of these level control units 324 to 328 with each other. The addition result is externally outputted as a left channel signal.

As previously explained, the left head related acoustic transfer function processor 32 can simulate the left head related acoustic transfer function in such a manner that the levels of the respective signals filtered out from the first to fourth filters 320 to 323 are controlled based on the amplification coefficients corresponding to the sound image localization directions.

In accordance with this sound image control apparatus, the cross-fade coefficient can be varied every 1 sampling time period (namely, 21 $\mu$s at sampling frequency of 40 kHz). As a consequence, in such a case that the parameters used to control the sound image are stored every 10 degrees, and a cross-fade coefficient corresponding to each of these parameter is subdivided into 100, and then the subdivided parameters are cross-faded to thereby move the sound image, a time required to circulate the sound image becomes $36\times100\times21$ $\mu$s=0.0756 seconds. Accordingly, this sound image control apparatus can move the sound image at a higher speed than that of the conventional sound image control apparatus.

It should be understood that although the four filters are employed so as to simulate the head related acoustic transfer function in this sound image control apparatus, a total number of these filters is not limited to 4, but may be selected to be an arbitrary number. Also, in the above-described embodiment, the input signal is supplied to the left head related acoustic transfer function processor 32, and further the output of the delay amount control means 31 is supplied to the right head related acoustic transfer function processor 33. Alternatively, according to the inventive idea of this invention, the input signal may be supplied to the right head related acoustic transfer function processor 33, and further the output of the delay amount control means 31 may be supplied to the left head related acoustic transfer function processor 32.

In accordance with this sound image control apparatus, the delay amount is varied without producing the noise, so that the sound image can be moved in the smooth manner and in high speeds. Similar to the above-explained delay amount control apparatus, the control sequence executed by the CPU can be made simple and the workload thereof can be reduced in this sound image control apparatus (DSP).

What is claimed is:

1. A delay amount control apparatus for delaying an externally supplied input signal based on an externally supplied delay coefficient to output a delayed input signal, comprising:

delay amount detecting means for detecting as to whether or not said delay coefficient is changed;

delay amount saving means for saving a delay coefficient before being changed when said delay amount detecting means detects that the delay coefficient is changed;

delay means for outputting a first delay signal produced by delaying the externally supplied input signal by a delay amount designated by said delay coefficient before being changed, which is saved in said delay mount saving means, and also a second delay signal produced by delaying the externally supplied input signal by a delay amount designated by the externally supplied delay coefficient; and cross-fade mixing means for cross-fading said first delay signal and said second delay signal outputted from said delay means so as to mix said first delay signal with said second delay signal, wherein said delay means includes a memory into which said externally supplied input signal is continuously stored and from which said externally supplied input signal existing in a location addressed by a reading address composed of said delay coefficient is read out, and said delay amount detecting means detects a change of said reading address.

2. A delay amount control apparatus according to claim 1, wherein said cross-fade mixing means sequentially adds said first delay signal decreased within a preselected time range to said second delay signal increased within said preselected time range.

3. A sound image control apparatus for producing sounds in response to a first channel signal and a second channel signal so as to localize a sound image, comprising:

delay amount control means for delaying an externally supplied input signal based upon a delay coefficient indicative of an inter aural time difference corresponding to a second image localization direction to thereby output a delayed externally supplied input signal;

first function processing means for processing said input signal in accordance with a first head related acoustic transfer function to thereby output the processed input signal as said first channel signal; and second function processing means for processing said delayed input signal derived from said delay amount control means in accordance with a second head related acoustic transfer function to thereby output the processed delayed input signal as said second channel signal, wherein said delay amount control means is composed of:

delay amount detecting means for detecting as to whether or not said delay coefficient is changed;

delay amount saving means for saving a delay coefficient before being changed when said delay amount detecting means detects that the delay coefficient is changed;

delay means for outputting a first delay signal produced by delaying the externally supplied input signal by a delay amount designated by said delay coefficient before being changed, which is saved in said delay amount saving means, and also a second delay signal produced by delaying the externally supplied input signal by a delay amount designated by the externally supplied delay coefficient; and cross-fade mixing means for cross-fading said first delay signal and said second delay signal outputted from said delay means so as to mix said first delay signal with said second delay signal.

4. A sound image control apparatus according to claim 3, further comprising:

storage means for storing therein both a delay coefficient and an amplification coefficient in correspondence with a sound image localization direction, wherein when the sound image localization direction is externally designated, the delay coefficient read from said storage means is supplied to said delay amount detecting means and said delay means included in said delay amount control means.

5. A sound image control apparatus according to claim 3, wherein each of said first function processing means and said second function processing means includes:

a plurality of fixed filters for filtering inputted signals with respect to each of frequency bands;

a plurality of amplifiers for amplifying signals filtered out from the respective fixed filters; and an adder for adding signals amplified by said plurality of amplifiers, wherein each of gains of said plural amplifiers is controlled so as to simulate the first and second head related acoustic transfer functions.

6. A sound image control apparatus according to claim 5, further comprising:

storage means for storing therein both a delay coefficient and an amplification coefficient in correspondence with a sound image localization direction, wherein when the sound image localization direction is externally designated, the amplification coefficient read from said storage means is supplied to said amplifiers included in said first function processing means and said second function processing means.

* * * * *

UNITED STATES PATENT AND TRADEMARK OFFICE

CERTIFICATE OF CORRECTION

PATENT NO. : 6,430,294 B1
DATED : August 6, 2002
INVENTOR(S) : Akihiro Fujita et al.

Figure 1:
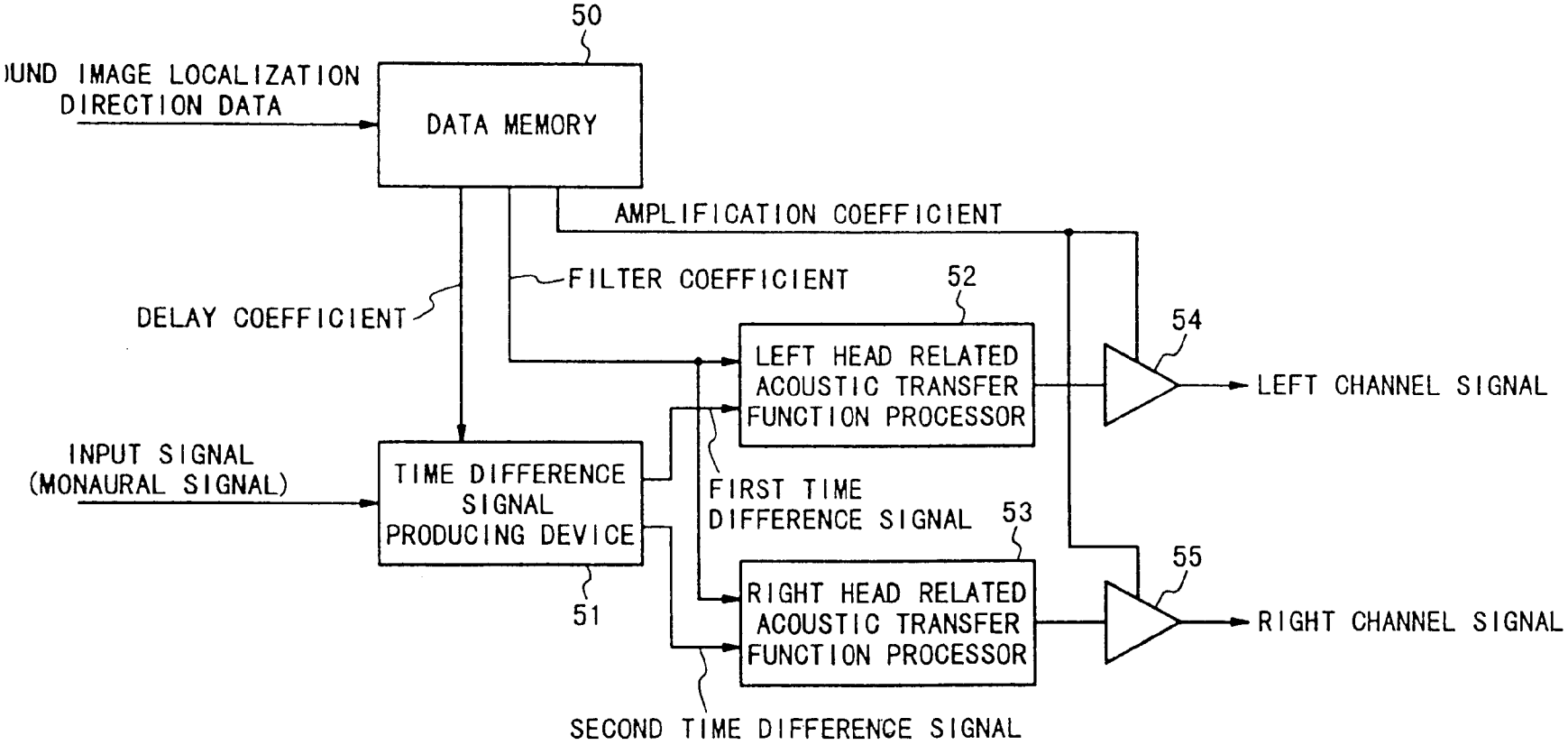
Fig. 1 PRIOR ART
FIG. 1 schematically illustrates the arrangement of the conventional sound image localization apparatus.
Figure 2:
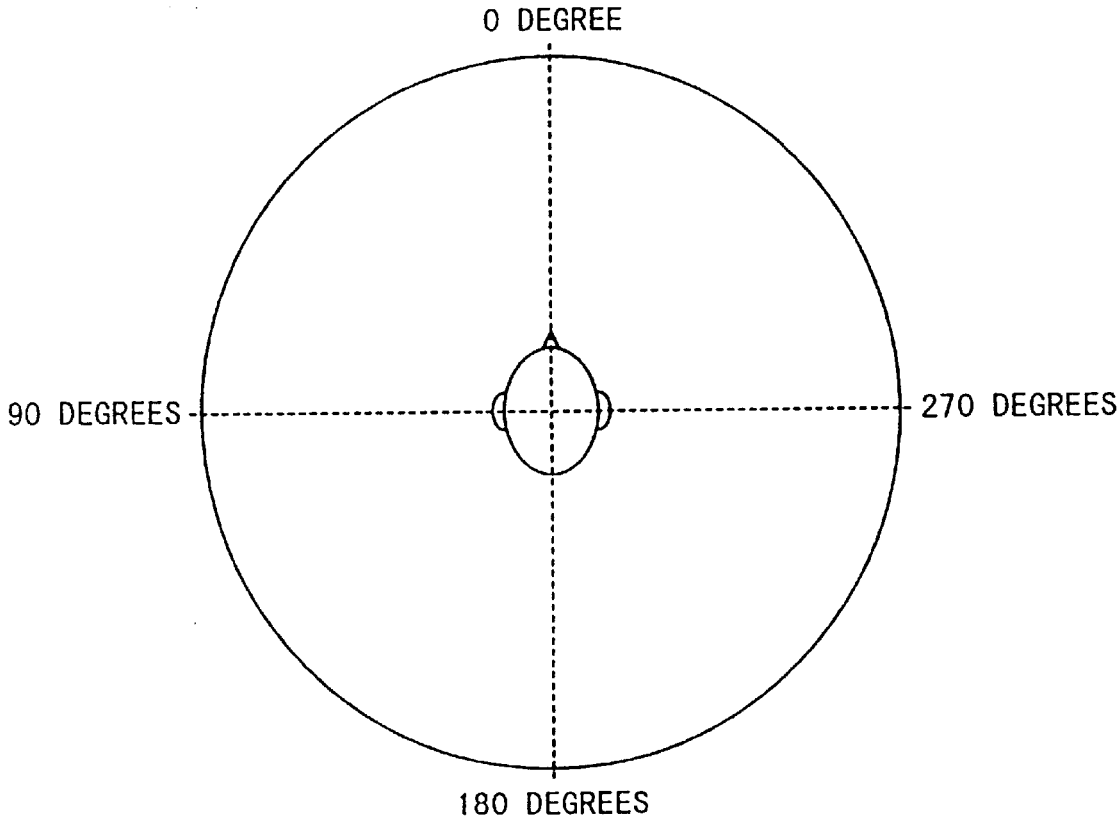
FIG. 2 is an illustration for schematically explaining the sound image localization directions, as viewed from the audience in the conventional sound image localization apparatus and also the sound image localization apparatus of the present invention.

It is certified that error appears in the above-identified patent and that said Letters Patent is hereby corrected as shown below:

Drawings,
Sheet 1 of 22, Fig. 1, replace “UND” with -- SOUND --.
Sheet 3 of 22, Fig. 3, replace “RIGET” with -- RIGHT --.
Sheet 6 of 22, Fig. 6, replace “FREQUANCY” with -- FREQUENCY --.
Sheet 9 of 22, Fig. 9, replace “DTRECTION” with -- DIRECTION --.
Sheet 11 of 22, Fig. 11, replace “CONECTION” with -- CONNECTION --.
Sheet 14 of 22, Fig. 15, replace “APPARETUS” with -- APPARATUS --.

Signed and Sealed this

Thirtieth Day of November, 2004

JON W. DUDAS
*Director of the United States Patent and Trademark Office*